US009557705B2

(12) United States Patent
Koseki et al.

(10) Patent No.: US 9,557,705 B2
(45) Date of Patent: Jan. 31, 2017

(54) IMAGE FORMING APPARATUS INCLUDING DETERMINATION OF AMOUNT OF WASTE TONER

(71) Applicant: CANON KABUSHIKI KAISHA, Tokyo (JP)

(72) Inventors: Manabu Koseki, Sakuragawa (JP); Yousuke Hata, Ichikawa (JP); Toshihide Shima, Abiko (JP); Hiroyuki Eda, Moriya (JP); Takeyuki Suda, Nagareyama (JP); Hirohisa Nakajima, Tsukubamirai (JP); Shinya Suzuki, Toride (JP); Toshiyuki Abe, Toride (JP); Kazumi Sato, Kashiwa (JP); Toshifumi Kakutani, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/993,622

(22) Filed: Jan. 12, 2016

(65) Prior Publication Data

US 2016/0202657 A1 Jul. 14, 2016

(30) Foreign Application Priority Data

Jan. 13, 2015 (JP) ..... 2015-004222
Jan. 13, 2015 (JP) ..... 2015-004523

(51) Int. Cl.
*G03G 21/00* (2006.01)
*G03G 21/10* (2006.01)

(52) U.S. Cl.
CPC ..... *G03G 21/10* (2013.01)

(58) Field of Classification Search
CPC ..... G03G 21/10; G03G 21/12
USPC ..... 399/35, 358, 360
See application file for complete search history.

(56) References Cited

U.S. PATENT DOCUMENTS 4,982,230 A * 1/1991 Ogura et al. ..... G03G 21/105 399/35
7,991,308 B2 * 8/2011 Oh ..... G03G 15/553 399/35
8,249,471 B2 * 8/2012 Kawahara ..... G03G 21/12 399/35
9,158,268 B2 * 10/2015 Sayama ..... G03G 21/12
2009/0060536 A1 3/2009 Kumagai

FOREIGN PATENT DOCUMENTS

JP 05-188835 A 7/1993
JP 2002-148884 A 5/2002

* cited by examiner

*Primary Examiner* — William J Royer
(74) *Attorney, Agent, or Firm* — Fitzpatrick, Cella, Harper & Scinto

(57) ABSTRACT

An image forming apparatus includes a waste toner container for containing toner recovered from a photosensitive drum and an intermediate transfer belt. The waste toner container has a stirring screw for conveying the toner in the waste toner container. The stirring screw is driven by a waste toner motor. A CPU determines whether the waste toner container is in need of replacement depending on a rotation speed or driving current of the waste toner motor. If the waste toner container is in need of replacement, the CPU displays such on a display unit to provide a notification to a user.

19 Claims, 19 Drawing Sheets

| BEFORE DETECTION OF FULL LOADING | AFTER DETECTION OF FULL LOADING | |
|---|---|---|
| ROTATION SPEED FOR ERROR Ne [rpm] | ROTATION SPEED FOR REPLACEMENT PREPARATION Nnf [rpm] | ROTATION SPEED FOR REPLACEMENT Nf [rpm] |
| 4500 | 5500 | 4500 |

FIG. 10

| VIDEO COUNT FOR REPLACEMENT PREPARATION Cnf | VIDEO COUNT FOR REPLACEMENT Cf |
|---|---|
| 197000 | 318000 |

FIG. 11

| BEFORE DETECTION OF FULL LOADING | AFTER DETECTION OF FULL LOADING | |
|---|---|---|
| CURRENT VALUE FOR ERROR Ae [mA] | CURRENT VALUE FOR REPLACEMENT PREPARATION Anf [mA] | CURRENT VALUE FOR REPLACEMENT Af [mA] |
| 300 | 200 | 300 |

| REPLACEMENT OF WASTE TONER CONTAINER |
| --- |
| WASTE TONER EXCEEDED PREDETERMINED AMOUNT.<br><br>PLEASE OPEN FRONT COVER AND REPLACE WASTE TONER CONTAINER IN ACCORDANCE WITH GUIDANCE.<br><br>WHEN WASTE TONER CONTAINER IS FULLY LOADED, EXECUTION OF IMAGE FORMING OPERATION IS PROHIBITED. |

FIG. 25A

| REPLACEMENT OF WASTE TONER CONTAINER |
| --- |
| WASTE TONER IS FULLY LOADED.<br><br>IMAGE FORMING OPERATION IS PROHIBITED.<br><br>PLEASE OPEN FRONT COVER AND REPLACE WASTE TONER CONTAINER IN ACCORDANCE WITH GUIDANCE. |

FIG. 25B

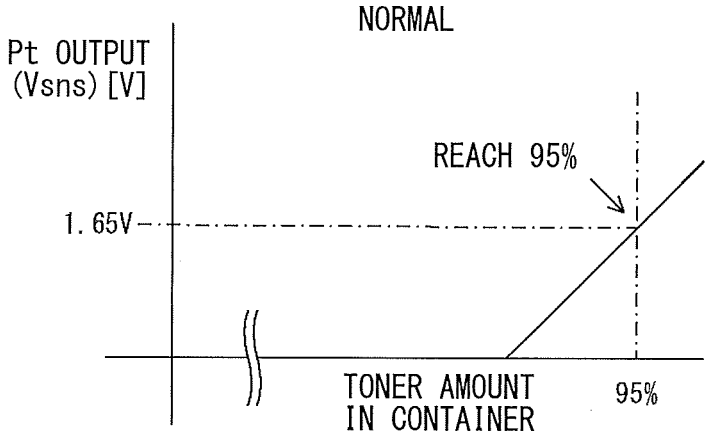
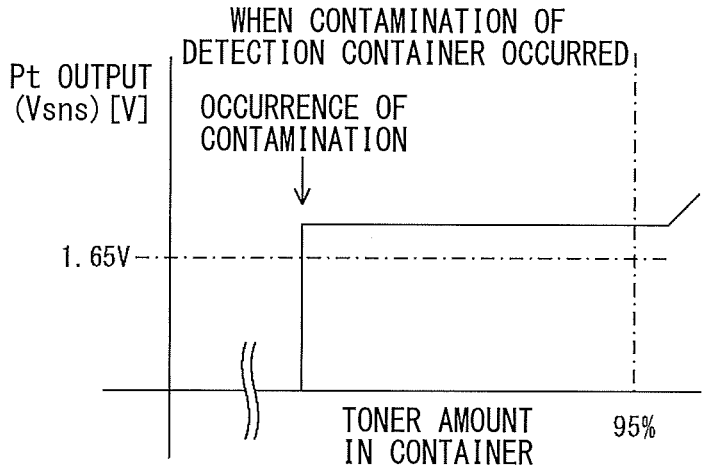
FIG. 26

IMAGE FORMING APPARATUS INCLUDING DETERMINATION OF AMOUNT OF WASTE TONER

BACKGROUND OF THE INVENTION

Field of the Invention

The present disclosure relates to an image forming apparatus using an electrophotographic system, such as a printer, a multifunction peripheral, a facsimile machine and the like.

Description of the Related Art

The image forming apparatus performs image forming processing by transferring a toner image formed on a photoreceptor to a recording medium such as a sheet. The toner remaining on the photoreceptor without being transferred after transferring the toner image (hereinafter referred to as "residual toner") is removed by a cleaner. The removed residual toner is contained in a waste toner container which is attachably/detachably provided in the image forming apparatus as waste toner. The image forming apparatus which forms a color image comprises a plurality of photoreceptors and is configured to contain all the waste toner in one waste toner container. Thereby, the waste toner container is required to have a corresponding capacity. The waste toner container is replaced when the waste toner is fully loaded.

Japanese Patent Application Laid-open No. 2002-148884 discloses an image forming apparatus comprising a waste toner container with a plurality of receiving ports for receiving a waste toner. The waste toner recovered by cleaners respectively provided on a plurality of photoreceptors is separately recovered into the waste toner container from each receiving port. To detect that the waste toner is fully loaded, the waste toner container comprises a light transmission sensor. When the waste toner in the waste toner container is accumulated and light from the light transmission sensor is shielded, the output of the light transmission sensor changes. Thereby, the image forming apparatus detects that the waste toner is fully loaded in the waste toner container.

Japanese Patent Application Laid-open No. 5-188835 discloses a toner recovery device comprising two detection sensors to distinguish the waste toner amount in a waste toner container in two stages. When a first detection sensor detects waste toner, the toner recovery device notifies in advance that the waste toner will be fully loaded. When a second detection sensor detects the waste toner, the toner recovery device notifies that the waste toner is fully loaded. Then, the toner recovery device automatically stops the operation of an image forming apparatus. United States Patent Application Publication No. US2009/060536 discloses an image forming apparatus which detects a waste toner amount in a waste toner container, and notifies in advance that the waste toner container will be fully loaded. Then, based on a number of printed sheets through an image forming processing performed thereafter, the image forming apparatus assumes and notifies that the waste toner container is fully loaded.

Japanese Patent Application Publication Laid-open No. 2002-148884 only detects that the waste toner is fully loaded in the waste toner container and does not notify in advance that the waste toner container will be fully loaded. Also, the light transmission sensor sometimes wrongly detects that the waste toner is fully loaded in the waste toner container when the light transmission sensor is contaminated. Japanese Patent Application Laid-open No. 5-188835 and United States Patent Application Publication No. US2009/060536 notify in advance before the waste toner container is fully loaded and assumes a filling ratio of the waste toner in the waste toner container.

A screw is provided in the waste toner container. By conveying and uniformly leveling the waste toner using the screw, the waste toner container is configured to fill the toner as much as possible in the waste toner container. With the conventional waste toner container, a state of the waste toner in the waste toner container cannot be checked. The state of the waste toner changes depending on a use state of the image forming apparatus, environmental temperature, environment humidity, and the like. There may be a case where, due to the change of the state of the waste toner, a load is rapidly applied to the screw, which results in deteriorating conveyance efficiency of the waste toner and the filling ratio of the waste toner in the waste toner container differs from what is assumed. Thereby, it is important to appropriately prompt a user to replace the waste toner container depending on the state of the waste toner container.

Thereby, an image forming apparatus which predicts the state of the waste toner contained in the waste toner container and prompts the user to replace the waste toner container at appropriate timing is desired. Also, an image forming apparatus which suppresses wrong detection of notification with regard to the replacement of the waste toner container is desired.

SUMMARY OF THE INVENTION

An image forming apparatus according to the present disclosure comprises an image carrier on which a toner image is formed; a transfer unit configured to transfer the toner image to a sheet from the image carrier; a cleaner configured to remove toner remaining on the image carrier after the transfer; a waste toner container having a screw, configured to contain the toner removed by the cleaner as waste toner; a sensor configured to sense an amount of the waste toner; a first determination unit configured to determine an amount of the waste toner in the waste toner container based on a number of sheets to which the toner image is transferred; a motor configured to drive the screw; a detection unit configured to detect a driving force of the motor; and a second determination unit configured to determine a state of the waste toner container based on the amount of the waste toner determined by the first determination unit or the driving force detected by the detection unit after the amount of the waste toner detected by the sensor is larger than a predetermined amount.

Further features of the present invention will become apparent from the following description of exemplary embodiments (with reference to the attached drawings).

BRIEF DESCRIPTION OF THE DRAWINGS

FIG. 10 is a diagram illustrating a rotation speed threshold table.

FIG. 11 is a diagram illustrating a video count threshold table.

FIGS. 25A and 25B are diagrams showing a display example of an operation panel.

FIG. 26 is a diagram showing a relation of a filling ratio of a waste toner container and an output voltage of a phototransistor.

DESCRIPTION OF THE EMBODIMENTS

In the following, embodiments are described in detail with reference to the accompanying drawings.

First Embodiment

Figure 1:
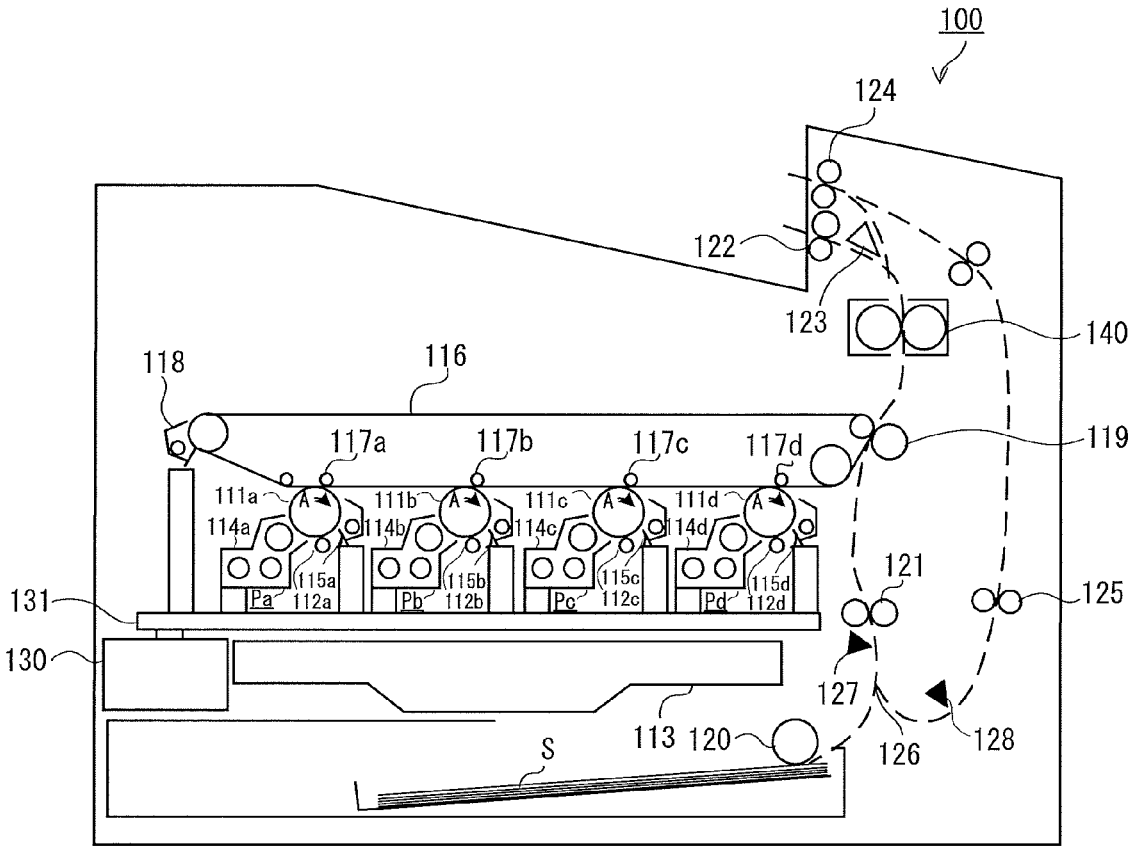
FIG. 1 is a configuration diagram of an image forming apparatus.

FIG. 1 is a configuration diagram of an image forming apparatus 100 according to the present embodiment. The image forming apparatus 100 has process units Pa, Pb, Pc, and Pd which perform image formation corresponding to each color of yellow (Y), magenta (M), cyan (C) and black (K). Each process unit Pa, Pb, Pc and Pd has the same configuration. In the following description, when distinguishing components by color, letters a, b, c, and d are placed at the end of the reference numerals. Otherwise, the letters a, b, c, and d are not placed at the end of the reference numerals. The letter "a" corresponds to yellow, "b" corresponds to magenta, "c" corresponds to cyan, and "d" corresponds to black. For example, the process unit for yellow is described as "process unit Pa". If the process unit is not distinguished by color, it is simply described as "process unit P".

The process unit P comprises a photosensitive drum 111 which is an image carrier on which a toner image is formed. The photosensitive drum 111 is driven by a driving unit (not shown) and is rotated at a constant speed in an arrow A direction. A charging roller 112, a developing unit 114, and a drum cleaner 115 are provided around the photosensitive drum 111. The charging roller 112 uniformly charges a surface of the photosensitive drum 111. An exposure unit 113 exposes the surface of the photosensitive drum 111 uniformly charged by the charging roller 112 by laser light modulated based on image data. Thereby, an electrostatic latent image is formed on the surface of the photosensitive drum 111 based on the image data.

The developing unit 114 develops the electrostatic latent image formed on the surface of the photosensitive drum 111 with developer containing toner and carrier. The electrostatic latent image formed on the photosensitive drum 111 is developed as a toner image. The developing unit 114*a* forms a yellow toner image. The developing unit 114*b* forms a magenta toner image. The developing unit 114*c* forms a cyan toner image. The developing unit 114*d* forms a black toner image.

An intermediate transfer belt 116 is placed on an upper part of each process unit P as an intermediate transfer body to which the toner image formed on the photosensitive drum 111 is transferred. The intermediate transfer belt 116 is also an example of the image carrier. A primary transfer roller 117 is provided at a position opposing to the photosensitive drum 111 interposing the intermediate transfer belt 116 therebetween. The photosensitive drum 111 and the primary transfer roller 117 form a transfer unit. The toner image formed on the photosensitive drum 111 is transferred to the intermediate transfer belt 116 by the primary transfer roller 117. The intermediate transfer belt 116 rotates at a constant speed in a counterclockwise direction in FIG. 1. By overlappingly transferring the toner images formed on each of the photosensitive drums 111*a* to 111*d* to the intermediate transfer belt 116 in order, a full color toner image is formed on the intermediate transfer belt 116.

The residual toner remaining on the photosensitive drum 111 after the transfer to the intermediate transfer belt 116 is removed by the drum cleaner 115. The photosensitive drum 111 having its surface cleaned by the drum cleaner 115 prepares for next image forming processing. The drum cleaner 115 conveys the removed residual toner through a waste toner conveyance path 131 and discharges the removed residual toner to a waste toner container 130 as waste toner.

The toner image having transferred to the intermediate transfer belt 116 is transferred to a recording medium S such as a sheet by a secondary transfer roller 119 which forms a transfer unit. The recording medium S is stored in a sheet feeding tray. The recording medium S is conveyed to the secondary transfer roller 119 one by one through a sheet feeding roller 120. A registration roller 121 is provided on a conveyance path between the sheet feeding roller 120 and the secondary transfer roller 119. The registration roller 121 performs skew correction and the like of the recording medium S. Then, the registration roller 121 conveys the recording medium S to the secondary transfer roller 119 in accordance with a timing at which the toner image formed on the intermediate transfer belt 116 is conveyed to the transfer unit. The secondary transfer roller 119 transfers the toner image formed on the intermediate transfer belt 116 to the recording medium S. The residual toner remaining on the surface of the intermediate transfer belt 116 after the transfer by the secondary transfer roller 119 is removed by a belt cleaner 118 which is provided around the intermediate transfer belt 116. The belt cleaner 118 conveys the removed residual toner through the waste toner conveyance path 131 and discharges the removed residual toner to the waste toner container 130 as the waste toner.

The recording medium S having the toner image transferred by the secondary transfer roller 119 is conveyed to a fixing unit 140. The fixing unit 140 thermally fixes the toner image on the recording medium S. The recording medium S having the toner image thermally fixed is discharged outside the image forming apparatus 100 from the fixing unit 140 through a sheet discharge roller 122.

A reversing flapper 123 is provided between the fixing unit 140 and the sheet discharge roller 122. When the image formation is to be performed on both sides of the recording medium S, the recording medium S having finished the image formation on one side is conveyed to a reversing roller 124 side through the reversing flapper 123. The reversing roller 124 conveys the recording medium S to a double-sided roller 125. The double-sided roller 125 conveys the recording medium S to the registration roller 121 via a joint part 126. Through the reversing roller 124 and the double-sided roller 125, the surface of the recording medium S having the image formed is reversed and again conveyed to the transfer unit.

In the conveyance path, a pre-registration sensor 127 is provided on an upstream side of the registration roller 121 and a double-sided sensor 128 is provided on a downstream side of the double-sided roller 125. The pre-registration sensor 127 and the double-sided sensor 128 are optical sensors and detect the recording medium S which is conveyed along the conveyance path.

Figure 2:
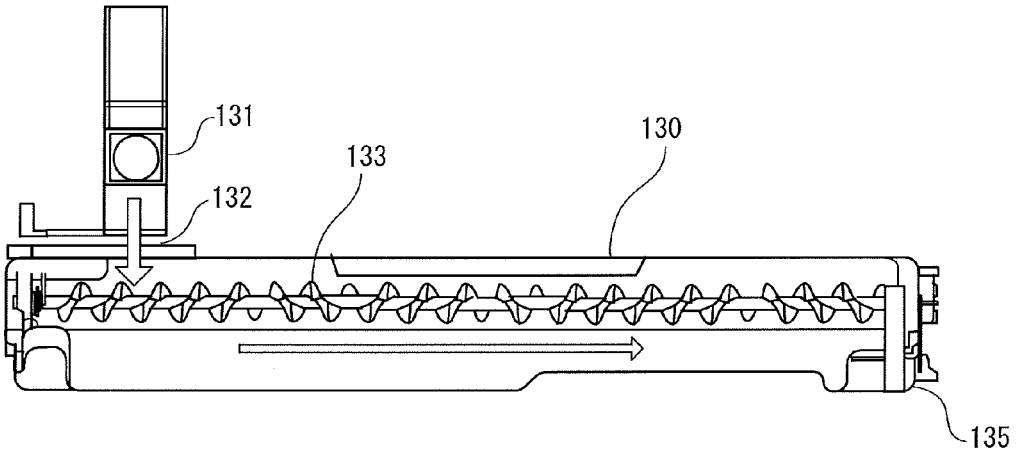
FIG. 2 is a cross-sectional diagram of a waste toner container.
Figure 3:
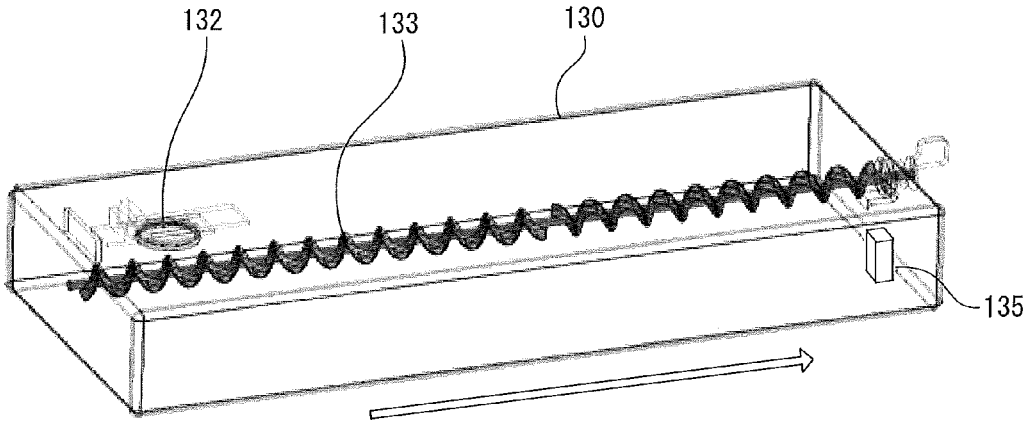
FIG. 3 is a perspective view of the waste toner container.

FIG. 2 is a cross-sectional diagram of the waste toner container 130. FIG. 3 is a perspective view of the waste toner container 130.

The waste toner container 130 is, for example, a container made of resin and having a rectangular shape. The waste toner container 130 is attachable to and detachable from the image forming apparatus 100. The waste toner container 130 is mounted to the image forming apparatus 100 such that its longitudinal direction is directed to a depth direction in FIG. 1. The waste toner container 130 has an opening 132 which is directed upward on an upper wall, which is an inflow port of the waste toner. The opening 132, comprising a shutter which opens and closes in conjunction with attachment and detachment of the waste toner container 130 to and from the image forming apparatus 100, closes when it is unmounted from the image forming apparatus 100. The waste toner container 130 has a built-in stirring screw 133 extending to a longitudinal direction. At an end opposite to the opening 132 of the waste toner container 130, a toner detection sensor 135, for detecting (sensing) the waste toner, is provided.

Figure 4:
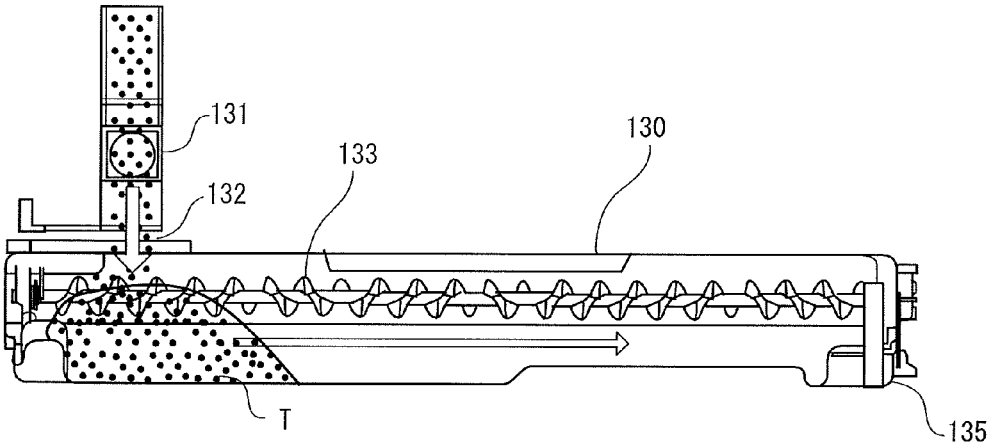
FIG. 4 is a diagram representing a state in which waste toner is being conveyed.
Figure 5:
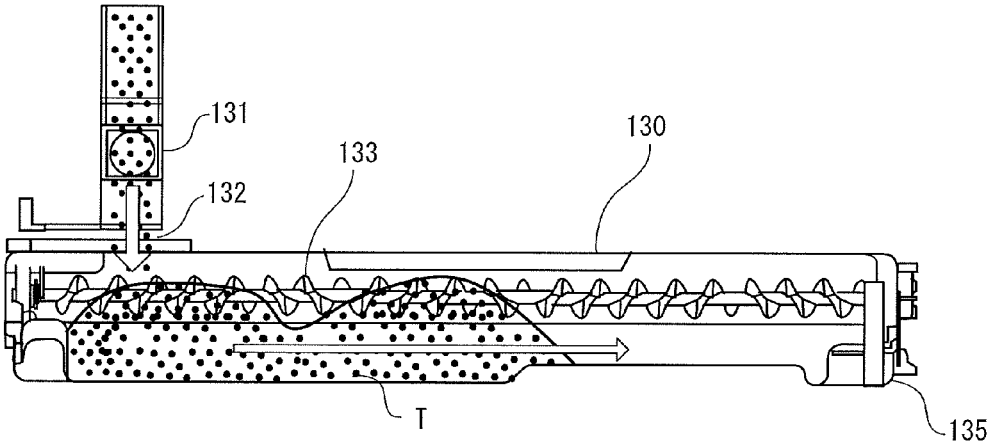
FIG. 5 is a diagram representing a state in which waste toner is being conveyed.
Figure 6:
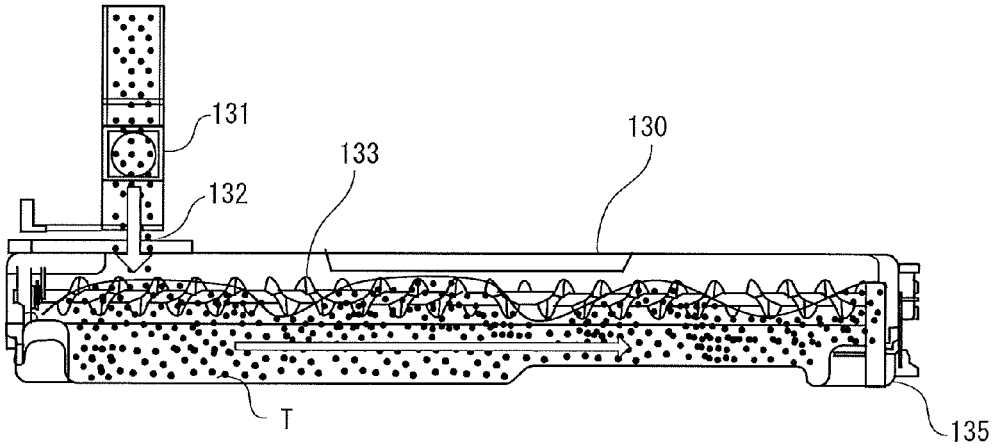
FIG. 6 is a diagram representing a state in which waste toner is being conveyed.

The waste toner having conveyed through the waste toner conveyance path 131 passes through the opening 132 and is contained in the waste toner container 130. The waste toner contained is conveyed in the longitudinal direction of the waste toner container 130 and uniformly leveled by rotating the stirring screw 133. FIG. 4, FIG. 5, and FIG. 6 represent how the waste toner is conveyed in the longitudinal direction by the stirring screw 133.

As shown in FIG. 4, the waste toner T having conveyed through the waste toner conveyance path 131 passes through the opening 132 and is contained in the waste toner container 130. The waste toner T accumulates in a vicinity of a bottom of the opening 132. When the stirring screw 133 rotates, the waste toner T, which is accumulating, is conveyed in the longitudinal direction of the waste toner container 130 (FIG. 5). The stirring screw 133 has a point to return and is configured such that the returned waste toner T conveyed to a fixed position in the longitudinal direction spreads in the waste toner container 130. When the waste toner T is further recovered, a state is changed from a state in FIG. 5 to a state in FIG. 6.

Figure 7:
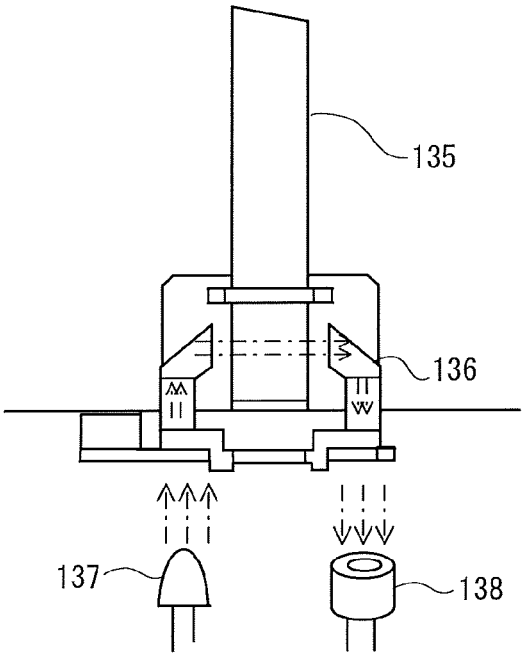
FIG. 7 is a configuration diagram of a toner detection sensor.
Figure 8:
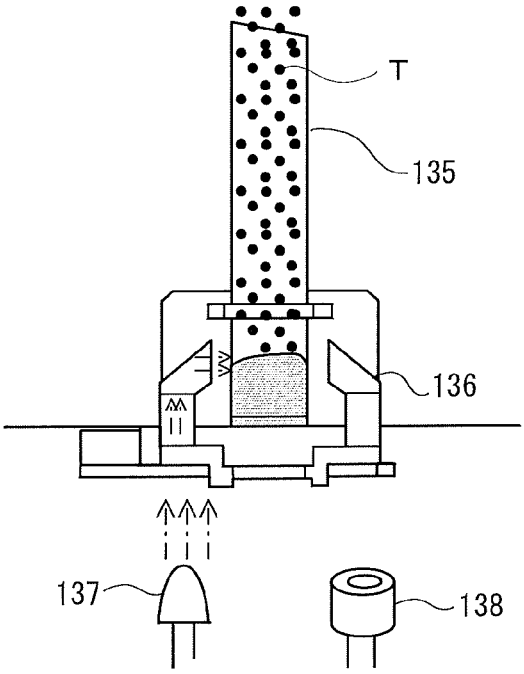
FIG. 8 is a diagram explaining when the waste toner is detected by the toner detection sensor.

When the waste toner container 130 is changed to the state shown in FIG. 6, the waste toner T is accumulated in the toner detection sensor 135. FIG. 7 is a configuration diagram of the toner detection sensor 135. The toner detection sensor 135 has a cylindrical shape and comprises a light emitting unit 137 and a light receiving unit 138. Light emitted from the light emitting unit 137 passes through an optical path 136 and is received by the light receiving unit 138. The optical path 136 transmits inside the cylinder of the toner detection sensor 135. In a state in which the waste toner T is not accumulating inside the cylinder, the light receiving unit 138 can receive light emitted from the light emitting unit 137. If the received waste toner T is accumulated inside the cylinder, the light emitted from the light emitting unit 137 is shielded by the waste toner T, which prevents the light receiving unit 138 from receiving light. FIG. 8 represents this state. Depending on how the light receiving unit 138 receives light, the toner detection sensor 135 can detect whether the waste toner T is fully loaded in the waste toner container 130. In a case where the light receiving unit 138 does not receive light, the toner detection sensor 135 detects that the waste toner T is fully loaded in the waste toner container 130. Inside the cylinder is an area where the waste toner T is detected.

Figure 9:
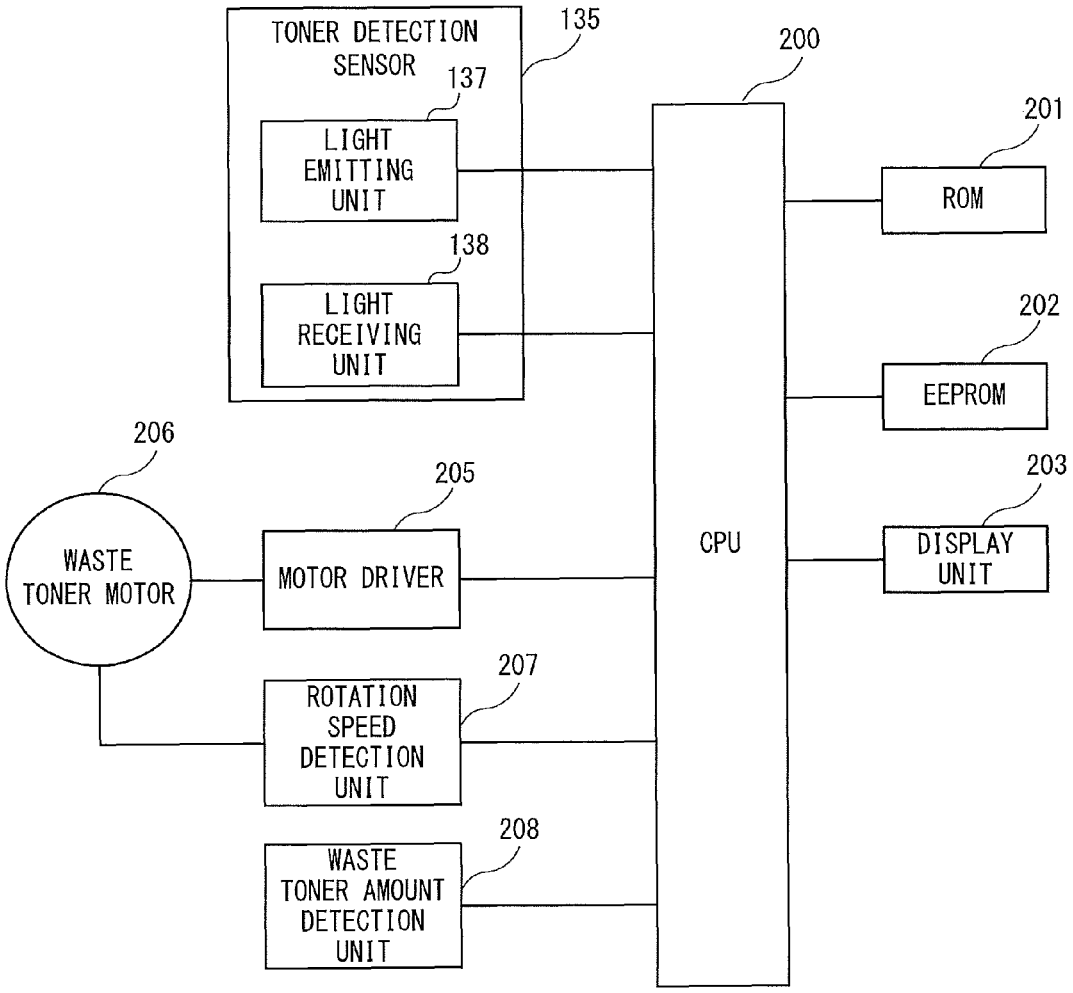
FIG. 9 is a configuration diagram of a control unit.

FIG. 9 is a configuration diagram of a control unit which controls an operation of such an image forming apparatus 100. The control unit performs entire control of each unit of the image forming apparatus 100 by reading and executing, by a central processing unit (CPU) 200, a computer program stored in a read only memory (ROM) 201. The ROM 201 stores various tables for calculating time to replace the waste toner container 130. FIG. 10 and FIG. 11 are diagrams illustrating the tables stored in the ROM 201.

FIG. 10 is a diagram illustrating a rotation speed threshold table. The rotation speed threshold table indicates a reference value of the rotation speed for determining a state of the waste toner container 130 (error, replacement preparation, replacement) depending on the rotation speed of a waste toner motor 206 which drives the stirring screw 133.

FIG. 11 is a diagram illustrating a video count threshold table. The video count threshold table indicates a reference value of the waste toner amount for determining a state of the waste toner container 130 (replacement preparation, replacement) depending on the waste toner amount corresponding to a video count value. The video count value is calculated based on the number of the recording media S having the image formed thereon and image DUTY which represents the toner amount transferred by one image formation. In addition, the control unit comprises an electrically erasable programmable read-only memory (EEPROM) 202. The EEPROM 202 stores the image DUTY, an integrated value of the waste toner amount, and the like.

A display unit 203, the toner detection sensor 135, a motor driver 205, a rotation speed detection unit 207, and a waste toner amount detection unit 208 are connected to the CPU 200. The motor driver 205 and the rotation speed detection unit 207 are connected to the waste toner motor 206.

The display unit 203 displays various messages to a user. In the present embodiment, the display unit 203 displays a message which prompts the replacement preparation and replacement of the waste toner container 130 or an error depending on the determination result by the CPU 200. As mentioned, the toner detection sensor 135 comprises the light emitting unit 137 and the light receiving unit 138 and detects the waste toner T contained in the waste toner container 130. The waste toner amount detection unit 208 detects the video count value based on the number of the recording media S having the image formed thereon and the image DUTY. The waste toner amount detection unit 208 calculates the waste toner amount based on the video count value and stores the calculated amount in the EEPROM 202. The number of the recording media S having the image formed thereon is counted by a counter (not shown). The calculated number of the recording media S is then stored in the EEPROM 202.

With a control signal such as a pulse width modulation (PWM) signal which is input from the CPU 200, the motor driver 205 controls drive of the waste toner motor 206 consisting of a brushless motor. The waste toner motor 206 rotationally drives the stirring screw 133 to convey the waste toner T contained in the waste toner container 130. The rotation speed detection unit 207 detects the rotation speed of the waste toner motor 206. The rotation speed detection unit 207 consists of an encoder and the like. The rotation speed detection unit 207 inputs the rotation speed detected to the CPU 200. The rotation speed represents driving force of the waste toner motor 206 and changes according to the weight of the waste toner T. By detecting the rotation speed, the rotation speed detection unit 207 detects the driving force. The CPU 200 compares the rotation speed with the rotation speed threshold table and determines the state of the waste toner container 130 (error, replacement preparation, replacement) depending on the comparison result.

Figure 12:
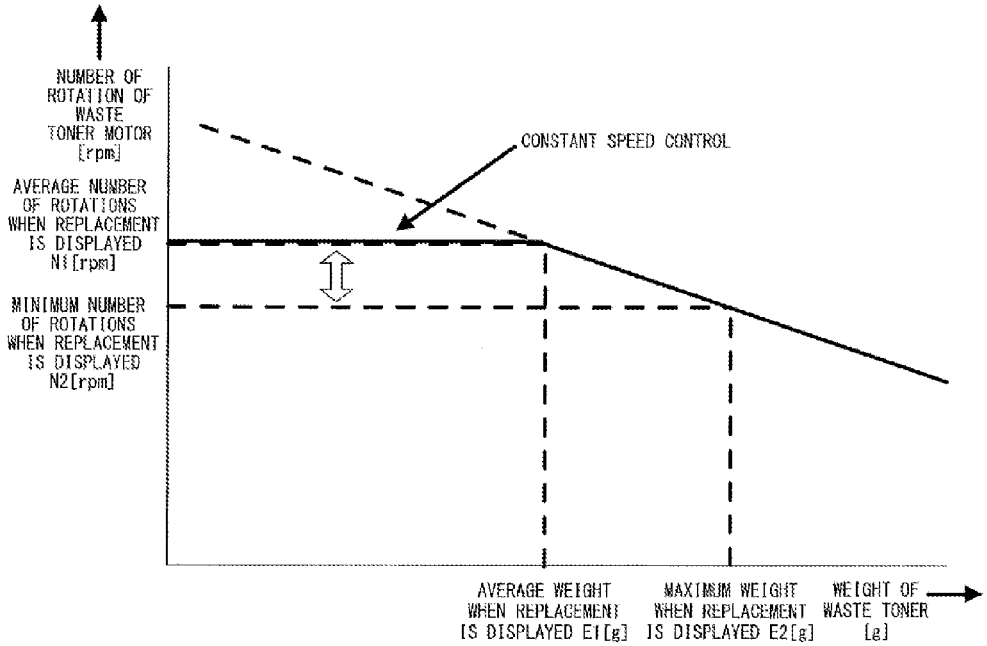
FIG. 12 is a diagram representing a relation of a rotation speed of a waste toner motor and a weight of a waste toner.
Figure 13:
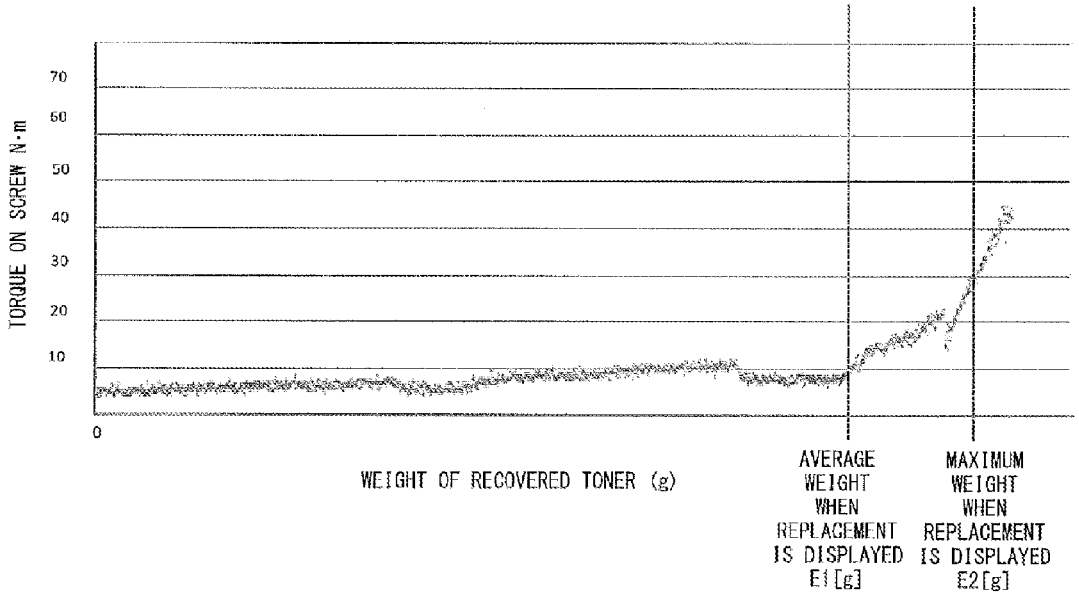
FIG. 13 is a diagram representing a relation of a torque of a screw and a weight of a waste toner.

FIG. 12 is a diagram representing the relation of the rotation speed of the waste toner motor 206 and the weight of the waste toner T contained in the waste toner container 130. The rotation speed of the waste toner motor 206 is controlled at constant speed until the waste toner T contained in the waste toner container 130 reaches average weight E1 [g]. The speed is the average number of rotations N1 [RPM]. The average weight E1 [g] represents the weight of the waste toner T when a message, prompting the replacement of the waste toner container 130, is displayed on the display unit 203 in a state in which the waste toner T is fully loaded. The weight of the waste toner T changes according to the density of the waste toner T contained in the waste toner container 130. The density of the waste toner T changes depending on a use state of the image forming apparatus 100, environmental temperature, environment humidity and the like. Thereby, there is a case where the weight of the waste toner T differs from what is assumed. In a case where the weight of the waste toner T is heavier than what is assumed, the filling ratio of the waste toner T in the waste toner container 130 becomes larger than what is assumed. This results in reducing the rotation speed of the waste toner motor 206. For example, in a case where the weight of the waste toner T becomes a maximum weight E2 [g] which is heavier than the average weight E1 [g], the rotation speed of the waste toner motor 206 is reduced to the minimum number of rotations N2 [RPM]. This is because torque of the stirring screw 133 rapidly increases due to a change of the weight of the waste toner T from the average weight E1 [g] to the maximum weight E2 [g]. FIG. 13 is a diagram representing the relation of the torque of the stirring screw 133 and the weight of the waste toner T, in which how the torque of the stirring screw 133 rapidly increases due to the change of the weight of the waste toner T from the average weight E1 [g] to the maximum weight E2 [g] is represented.

Thereby, not only the detection result of the waste toner amount detection unit 208, but by detecting the rotation speed of the waste toner motor 206, it is possible to assume the waste toner T contained in the waste toner container 130 to accurately estimate the filling ratio of the waste toner T. The control unit can notify the message, prompting the replacement preparation and replacement of the waste toner container 130, to the user depending on the filling ratio.

Figure 14:
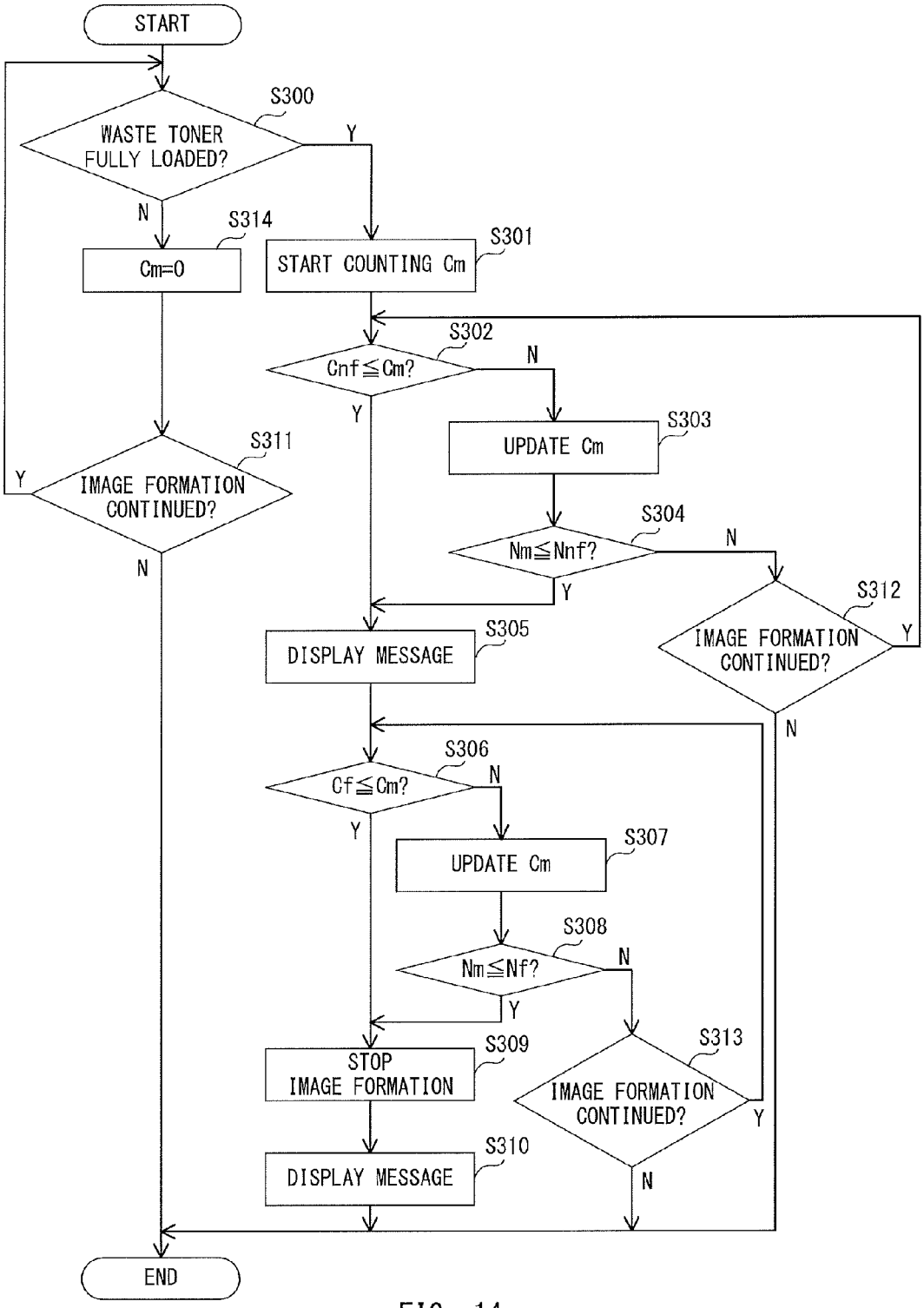
FIG. 14 is a flowchart representing processing to notify a user of replacement preparation and replacement of the waste toner container.

FIG. 14 is a flowchart representing processing to notify the user of the replacement preparation and replacement of the waste toner container 130. In the present embodiment, these notifications are provided to the user through the display of the message on the display unit 203. Instead, these notifications may be provided to the user through a predetermined method such as notification by lighting a lamp or by a sound.

When the image forming apparatus 100 starts the image forming processing, the CPU 200 determines whether the waste toner T is fully loaded in the waste toner container 130 based on whether the toner detection sensor 135 detects the waste toner T or not (S300). The CPU 200 continuously performs this determination during the image forming processing.

If the toner detection sensor 135 does not detect the waste toner T, the CPU 200 determines that the waste toner T is not fully loaded in the waste toner container 130 (S300: N) and initializes a video count value Cm to "0" (S314). If the image forming apparatus 100 continues the image forming processing (S311: Y), the CPU 200 repeatedly performs determination of whether the waste toner T is fully loaded in the waste toner container 130 or not according to the detection result of the toner detection sensor 135 (S300). If the image forming apparatus 100 does not continue the image forming processing (S311: N), the CPU 200 ends the processing.

In a case where the toner detection sensor 135 detects the waste toner T, the CPU 200 determines that the waste toner T is fully loaded in the waste toner container 130 (S300: Y) and starts to count the video count value Cm by the waste toner amount detection unit 208 (S301). The CPU 200 compares the video count value Cm with the video count threshold table (see FIG. 11) stored in the ROM 201. The CPU 200 determines whether or not the video count value Cm is equal to or more than a video count value Cnf, based on which, the video count value Cm notifies the replacement preparation of the waste toner container 130 (S302). If it is determined that the video count value Cm is equal to or more than the video count value Cnf (S302: Y), the CPU 200 displays a message of "Please prepare replacement of waste toner container" on the display unit 203 (S305).

If it is determined that the video count value Cm is less than the video count value Cnf (S302: N), the CPU 200 adds a value calculated by the waste toner amount detection unit 208 based on the number of the recording media S having the image formed thereon and the image DUTY to the video count value Cm (S303). The CPU 200 compares a rotation speed Nm of the waste toner motor 206 detected by the rotation speed detection unit 207 with the rotation speed threshold table (see FIG. 10) stored in the ROM 201. The CPU 200 determines whether or not the rotation speed Nm is less than or equal to the rotation speed Nnf, based on which, a rotation speed video notifies the replacement preparation of the waste toner container 130 (S304). If it is determined that the rotation speed Nm is less than or equal to the rotation speed Nnf (S304: Y), the CPU 200 displays a message of "Please prepare replacement of waste toner container" on the display unit 203 (S305). If the rotation speed Nm is faster than the rotation speed Nnf (S304: N), the CPU 200 determines whether the image forming apparatus 100 continues the image forming processing or not (S312). If it is determined that the image forming apparatus 100 continues the image forming processing (S312: Y), the CPU 200 again determines whether the video count value Cm is equal to or more than the video count value Cnf or not (S302). If it is determined that the image forming apparatus 100 does not continue the image forming processing (S312: N), the CPU 200 ends the processing.

The CPU 200 having displayed the message on the display unit 203 in the processing of S305 compares the video count value Cm with the video count threshold table (see FIG. 11) stored in the ROM 201. The CPU 200 determines whether or not the video count value Cm is equal to or more than a video count value Cf, based on which, the video count value Cm notifies the replacement of the waste toner container 130 (S306). If it is determined that the video count value Cm is equal to or more than the video count value Cf (S306: Y), the CPU 200 stops the image forming processing by the image forming apparatus 100 (S309).

If it is determined that the video count value Cm is less than the video count value Cf (S306: N), the CPU 200 adds a value calculated by the waste toner amount detection unit 208 based on the number of the recording media S having the image formed thereon and the image DUTY to the video count value Cm (S307). The CPU 200 compares the rotation speed Nm of the waste toner motor 206 detected by the rotation speed detection unit 207 with the rotation speed threshold table (see FIG. 10) stored in the ROM 201. The CPU 200 determines whether or not the rotation speed Nm is less than or equal to the rotation speed Nf, based on which, the rotation speed video notifies the replacement of the waste toner container 130 (S308). If the rotation speed Nm is less than or equal to the rotation speed Nf (S308: Y), the CPU 200 stops the image forming processing by the image forming apparatus 100 (S309).

If the rotation speed Nm is faster than the rotation speed Nf (S308: N), the CPU 200 determines whether the image forming apparatus 100 continues the image forming processing or not (S313). If it is determined that the image forming apparatus 100 continues the image forming processing (S313: Y), the CPU 200 again determines whether the video count value Cm is equal to or more than the video count value Cf or not (S306). If it is determined that the image forming apparatus 100 does not continue the image forming processing (S313: N), the CPU 200 ends the processing.

The CPU 200 having stopped the image forming processing by the image forming apparatus 100 in the processing of S309 displays a message of "please replace waste toner container" on the display unit 203 (S310). This message is continuously displayed until the waste toner container 130 is replaced with a new one.

It is noted that there is a case where the toner detection sensor 135 does not detect the waste toner T and the rotation speed of the waste toner motor 206 becomes less than the rotation speed Ne [rpm] shown in the rotation speed threshold table in FIG. 10. The rotation speed Ne [rpm] is a value when it is determined that an abnormality has occurred to the waste toner motor 206 or the waste toner container 130. This abnormality occurs, for example, when abnormal torque occurs to the stirring screw 133 due to uneven distribution of the waste toner T in the waste toner container 130. In this case, the CPU 200 displays a message representing the occurrence of an error on the display unit 203.

Second Embodiment

Figure 15:
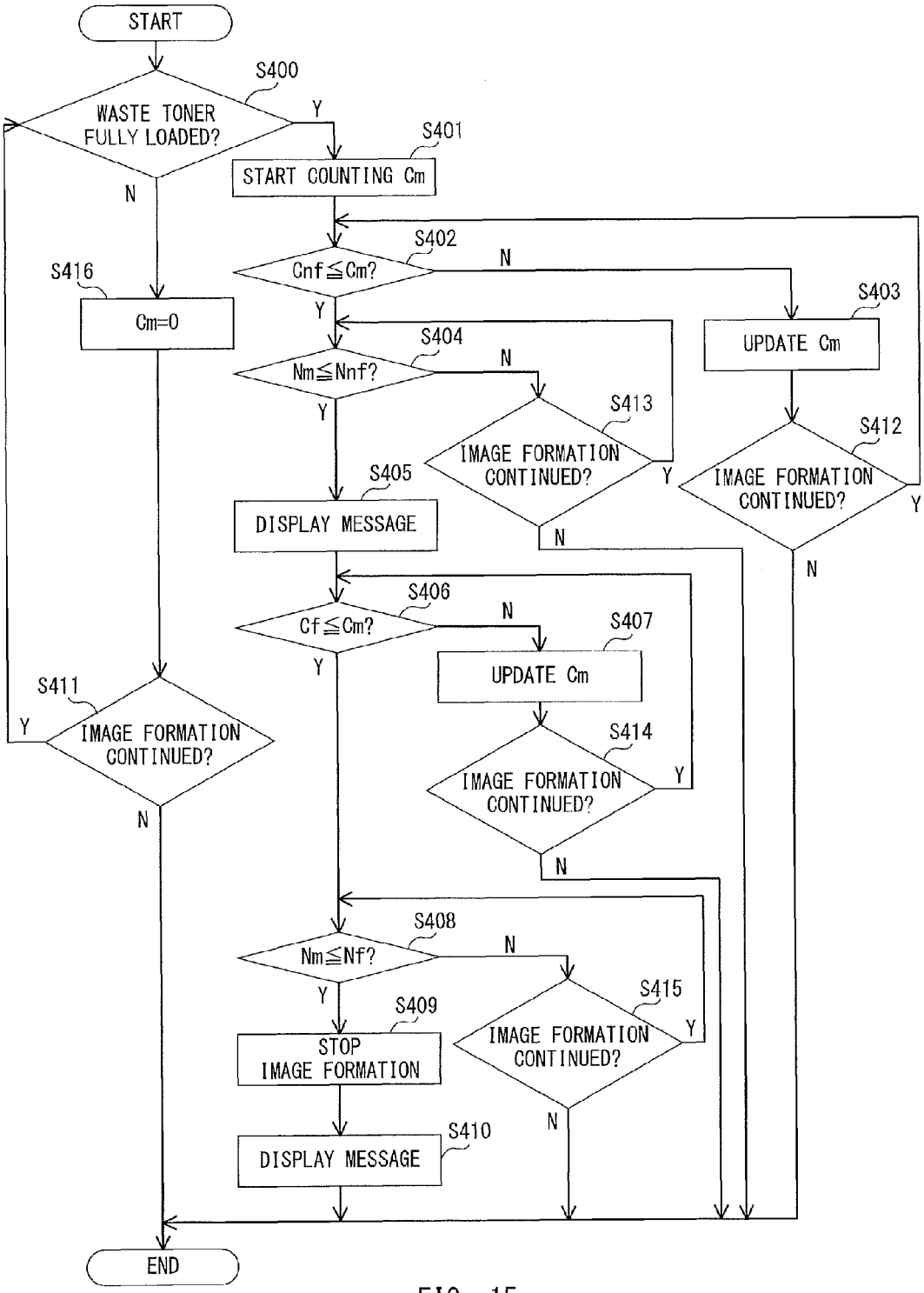
FIG. 15 is a flowchart representing processing to notify the user of replacement preparation and replacement of the waste toner container.

FIG. 15 is a flowchart of a second embodiment representing processing to notify the user of the replacement preparation and replacement of the waste toner container 130. The image forming apparatus 100 and the control unit of the second embodiment are similarly configured to those of the first embodiment so that the description thereof is omitted. In the present embodiment, these notifications are provided to the user through the display of the message on the display unit 203. Instead, these notifications may be provided to the user through a predetermined method such as informing by lighting a lamp or informing by a sound.

When the image forming apparatus 100 starts the image forming processing, the CPU 200 determines whether the waste toner T is fully loaded in the waste toner container 130 or not based on whether the toner detection sensor 135 detects the waste toner T or not (S400). The CPU 200 continuously performs this determination during the image forming processing.

If the toner detection sensor 135 does not detect the waste toner T, the CPU 200 determines that the waste toner T is not fully loaded in the waste toner container 130 (S400: N) and initializes the video count value Cm to "0" (S416). If the image forming apparatus 100 continues the image forming processing (S411: Y), the CPU 200 repeatedly performs determination of whether the waste toner T is fully loaded in the waste toner container 130 or not according to the detection result of the toner detection sensor 135 (S400). If the image forming apparatus 100 does not continue the image forming processing (S411: N), the CPU 200 ends the processing.

In a case where the toner detection sensor 135 detects the waste toner T, the CPU 200 determines that the waste toner T is fully loaded in the waste toner container 130 (S400: Y) and starts to count the video count value Cm (S401). The CPU 200 compares the video count value Cm with the video count threshold table (see FIG. 11) stored in the ROM 201. The CPU 200 determines whether or not the video count value Cm is equal to or more than a video count value Cnf (S402).

If it is determined that the video count value Cm is less than the video count value Cnf (S402: N), the CPU 200 adds a value calculated by the waste toner amount detection unit 208 based on the number of the recording media S having the image formed thereon and the image DUTY to the video count value Cm (S403). The CPU 200 having updated the video count value determines whether the image forming apparatus 100 continues the image forming processing or not (S412). If it is determined that the image forming apparatus 100 continues the image forming processing (S412: Y), the CPU 200 again determines whether the video count value Cm is equal to or more than the video count value Cnf or not (S402). If it is determined that the image forming apparatus 100 does not continue the image forming processing (S412: N), the CPU 200 ends the processing.

If it is determined that the video count value Cm is equal to or more than the video count value Cnf (S402: Y), the CPU 200 compares the rotation speed Nm of the waste toner motor 206 detected by the rotation speed detection unit 207 with the rotation speed threshold table (see FIG. 10) stored in the ROM 201. The CPU 200 determines whether the rotation speed Nm is less than or equal to the rotation speed Nnf or not (S404). If it is determined that the rotation speed Nm is faster than the rotation speed Nnf (S404: N), the CPU 200 determines whether the image forming apparatus 100 continues the image forming processing or not (S413). If it is determined that the image forming apparatus 100 does not continue the image forming processing (S413: N), the CPU 200 ends the processing. If it is determined that the image forming apparatus 100 continues the image forming processing (S413: Y), the CPU 200 again determines whether the rotation speed Nm is less than or equal to the rotation speed Nnf or not (S404).

If it is determined that the rotation speed Nm is less than or equal to the rotation speed Nnf (S404: Y), the CPU 200 displays a message of "Please prepare replacement of waste toner container" on the display unit 203 (S405). After displaying the message, the CPU 200 compares the video count value Cm with the video count threshold table (see FIG. 11). The CPU 200 determines whether the video count value Cm is equal to or more than the video count value Cf or not (S406).

If it is determined that the video count value Cm is less than the video count value Cf (S406: N), the CPU 200 adds a value calculated by the waste toner amount detection unit 208 based on the number of the recording media S having the image formed thereon and the image DUTY to the video count value Cm (S407). The CPU 200 having updated the video count value determines whether the image forming apparatus 100 continues the image forming processing or not (S414). If it is determined that the image forming apparatus 100 continues the image forming processing (S414: Y), the CPU 200 again determines whether the video count value Cm is equal to or more than the video count value Cf or not (S406). If it is determined that the image forming apparatus 100 does not continue the image forming processing (S414: N), the CPU 200 ends the processing.

If it is determined that the video count value Cm is equal to or more than the video count value Cf (S406: Y), the CPU 200 compares the rotation speed Nm of the waste toner motor 206 detected by the rotation speed detection unit 207 with the rotation speed threshold table (see FIG. 10) stored in the ROM 201. The CPU 200 determines whether or not the rotation speed Nm is less than or equal to the rotation speed Nf, based on which, the rotation speed Nm determines the replacement of the waste toner container 130 (S408). If the rotation speed Nm is less than or equal to the rotation speed Nf (S408: Y), the CPU 200 stops the image forming processing by the image forming apparatus 100 (S409).

If it is determined that the rotation speed Nm is faster than the rotation speed Nf (S408: N), the CPU 200 determines whether the image forming apparatus 100 continues the image forming processing or not (S415). If it is determined that the image forming apparatus 100 continues the image forming processing (S415: Y), the CPU 200 again determines whether the rotation speed Nm is less than or equal to the rotation speed Nf or not (S408). If it is determined that the image forming apparatus 100 does not continue the image forming processing (S415: N), the CPU 200 ends the processing.

The CPU 200 having stopped the image forming processing by the image forming apparatus 100 in the processing of S409 then displays a message of "please replace waste toner container" on the display unit 203 (S410). This message is continuously displayed until the waste toner container 130 is replaced with a new one.

In the first embodiment and the second embodiment, not only by using the waste toner amount detection unit 208, but also by detecting the rotation speed of the waste toner motor 206, it is possible to accurately predict the filling ratio of the waste toner T contained in the waste toner container 130. The control unit can notify the user of the message prompting the replacement preparation and replacement of the waste toner container 130 at appropriate timing.

Third Embodiment

Figure 16:
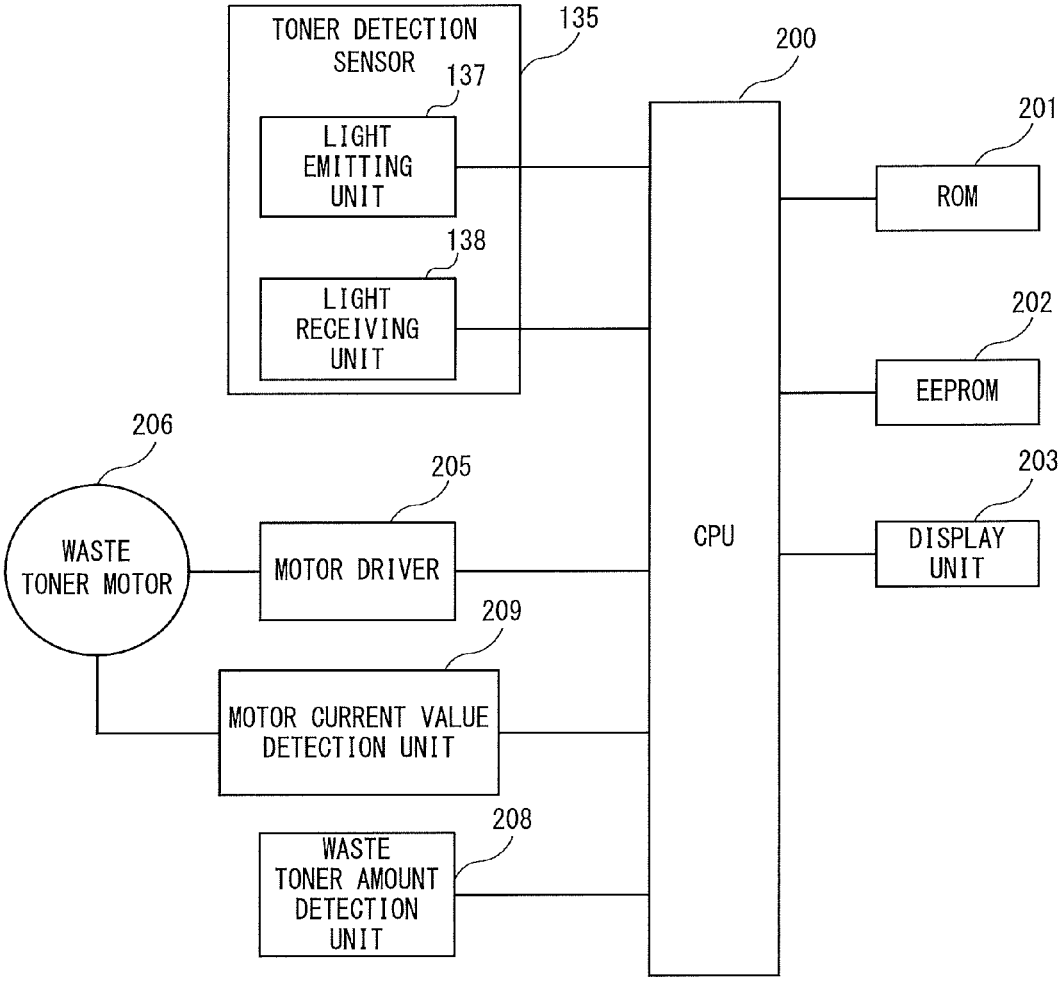
FIG. 16 is a configuration diagram of a control unit.
Figures 17, 18:
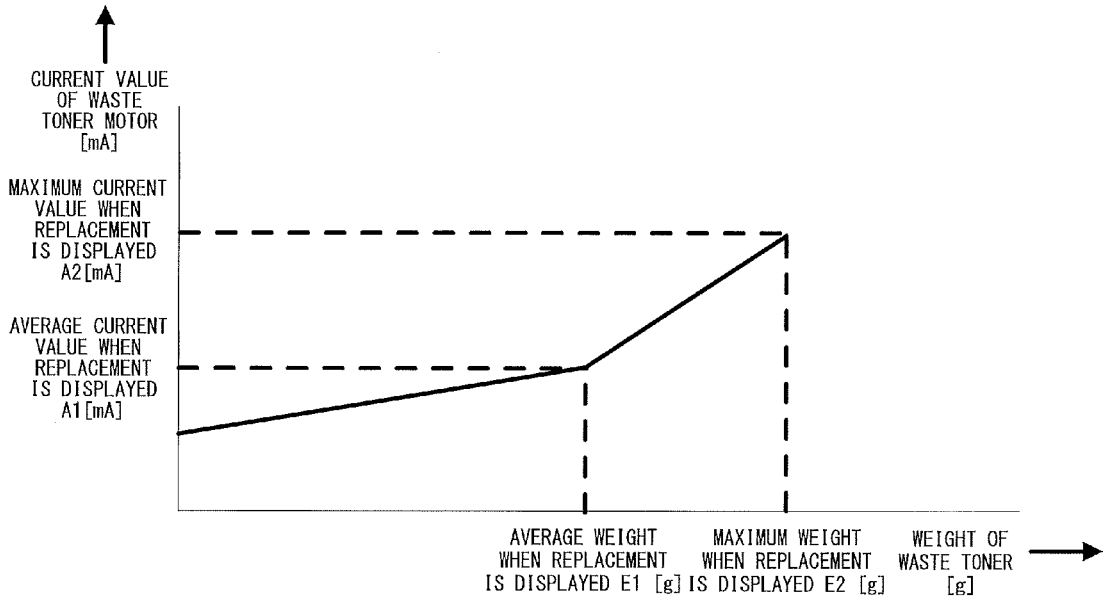
FIG. 17 is a diagram illustrating a motor current value threshold table.
FIG. 18 is a diagram representing a relation of a driving current of a waste toner motor and a weight of a waste toner.

FIG. 16 is a configuration diagram of a control unit according to a third embodiment. The image forming apparatus 100 of the third embodiment is similarly configured to that of the first embodiment so that the description thereof is omitted. In the control unit of the third embodiment, a motor current value detection unit 209 is used, instead of the rotation speed detection unit 207 of the control unit of the first embodiment (see FIG. 9). Also, a motor current value threshold table is stored in the ROM 201. FIG. 17 is a diagram illustrating the motor current value threshold table. The motor current value threshold table indicates a reference value of a current value for determining a state of the waste toner container 130 (error, replacement preparation, replacement) depending on driving current of the waste toner motor 206 which drives the stirring screw 133.

The motor current value detection unit 209 detects a current value of the driving current of the waste toner motor 206. The driving current represents the driving force of the waste toner motor 206 and changes according to the weight of the waste toner T. The motor current value detection unit 209 detects the driving force by detecting the current value of the driving current. FIG. 18 is a diagram representing the relation of the driving current of the waste toner motor 206 and the weight of the waste toner T contained in the waste toner container 130.

The driving current of the waste toner motor 206 gently increases until the waste toner T contained in the waste toner container 130 reaches the average weight E1 [g]. The driving current when the waste toner T contained in the waste toner container 130 reaches the average weight E1 [g] is an average current value A1 [mA]. The average weight E1 [g] represents the weight of the waste toner T when the message, prompting the replacement of the waste toner container 130, is displayed on the display unit 203. The density of the waste toner T contained in the waste toner container 130 changes depending on a use state of the image forming apparatus 100, environmental temperature, environment humidity and the like. Thereby, there is a case where the weight of the waste toner T differs from what is assumed. In a case where the weight of the waste toner T is heavier than what is assumed, the filling ratio of the waste toner T in the waste toner container 130 becomes larger than what is assumed. This results in rapid increase of the driving current of the waste toner motor 206. For example, in a case where the weight of the waste toner T becomes the maximum weight E2 [g] which is heavier than the average weight E1 [g], the driving current of the waste toner motor 206 increases to a maximum current value A2 [mA]. This is because, as shown in FIG. 13, the torque of the stirring screw 133 rapidly increases due to a change of the weight of the waste toner T from the average weight E1 [g] to the maximum weight E2 [g]. Thereby, it is important to maintain the torque of the stirring screw 133 which conveys the waste toner T to maintain conveyance force by reducing variation between these sections.

Figure 19:
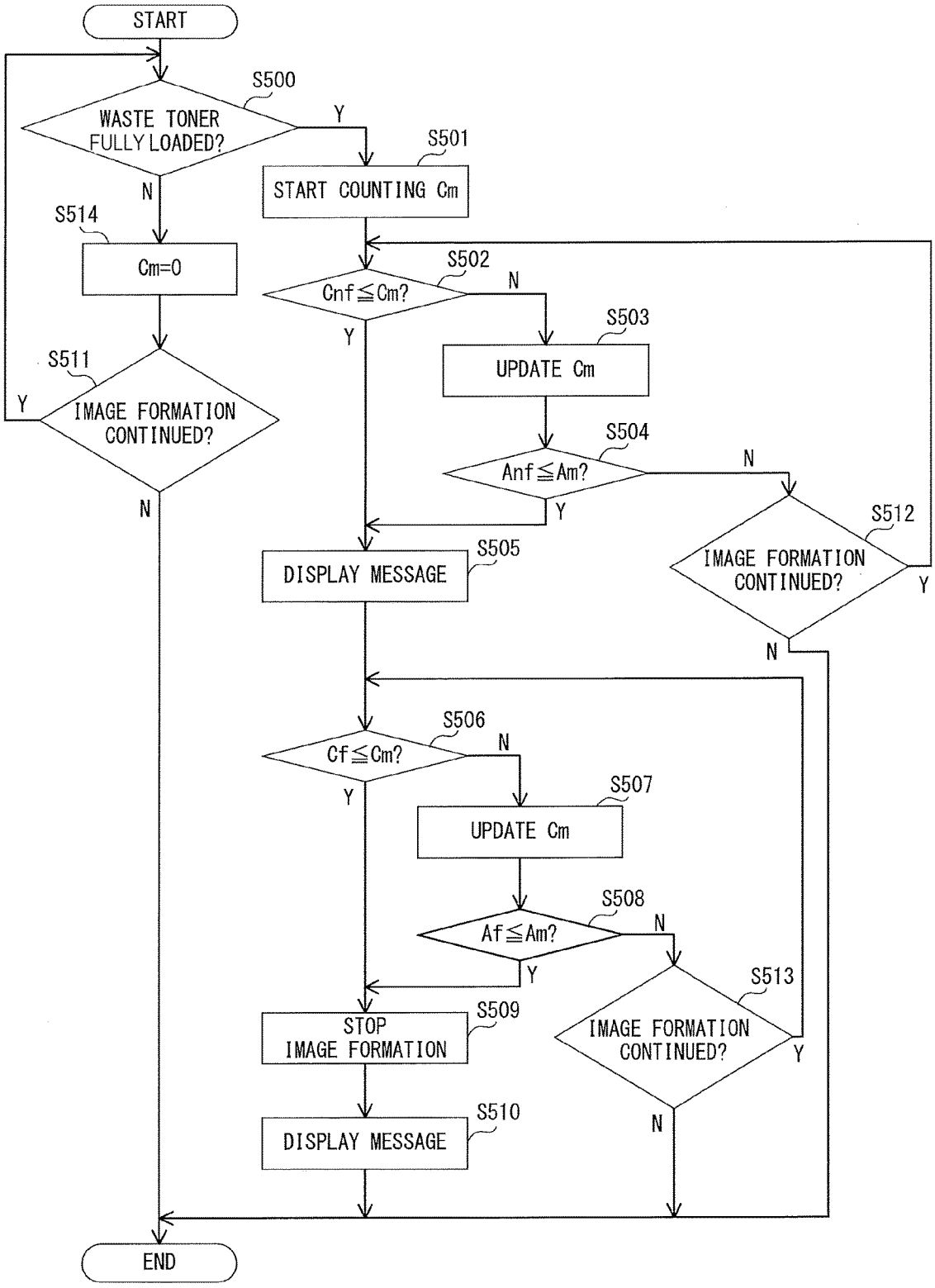
FIG. 19 is a flowchart representing processing to notify the user of replacement preparation and replacement of the waste toner container.

FIG. 19 is a flowchart of the third embodiment representing processing to inform the user of the replacement preparation and replacement of the waste toner container 130. When comparing with the flowchart of the first embodiment shown in FIG. 14, the processing of S500 to S503, S505 to S507, and S509 to S514 respectively corresponds to the processing of S300 to S303, S305 to S307, and S309 to S314. A description is omitted with regard to these processings.

The CPU 200 having updated the video count value Cm in the processing of S503 then compares a current value Am of the driving current of the waste toner motor 206 detected by the motor current value detection unit 209 with the current value threshold table (see FIG. 17) stored in the ROM 201. The CPU 200 determines whether or not the current value Am is equal to or more than a current value Anf, based on which, the current value Am notifies the replacement preparation of the waste toner container 130 (S504). If it is determined that the current value Am is equal to or more than the current value Anf (S504: Y), the CPU 200 displays a message of "Please prepare replacement of waste toner container" on the display unit 203 (S505). If it is determined that the current value Am is less than the current value Anf (S504: N), the CPU 200 determines whether the image forming apparatus 100 continues the image forming processing or not (S512).

The CPU 200 having updated the video count value Cm in the processing of S507 compares the current value Am of the driving current of the waste toner motor 206 detected by the motor current value detection unit 209 with the current value threshold table (see FIG. 17) stored in the ROM 201. The CPU 200 determines whether or not the current value Am is equal to or more than a current value Af, based on which, the current value Am notifies the replacement of the waste toner container 130 (S508). If it is determined that the current value Am is equal to or more than the current value Af (S508: Y), the CPU 200 stops the image forming processing by the image forming apparatus 100 (S509). Thereafter, the CPU 200 displays a message of "Please replace waste toner container" on the display unit 203 (S510). If it is determined that the current value Am is less than the current value Af (S508: N), the CPU 200 determines whether the image forming apparatus 100 continues the image forming processing or not (S513).

It is noted that there is a case where the toner detection sensor 135 does not detect the waste toner T and the driving current of the waste toner motor 206 becomes less than a current value Ae [mA] shown in the current value threshold table in FIG. 10. The current value Ae [mA] is a value when it is determined that an abnormality has occurred to the waste toner motor 206 or the waste toner container 130. This abnormality occurs, for example, when abnormal torque occurs to the stirring screw 133 due to uneven distribution of the waste toner T in the waste toner container 130. In this case, the CPU 200 displays a message showing the occurrence of an error on the display unit 203.

In the third embodiment, not only by using the waste toner amount detection unit 208, but also by detecting the driving current of the waste toner motor 206, it is possible to accurately predict the filling ratio of the waste toner T contained in the waste toner container 130. The control unit can notify the user of the message prompting the replacement preparation and replacement of the waste toner container 130 at appropriate timing.

The image forming apparatus 100 of the first to third embodiments as previously mentioned can prompt the user to replace the waste toner container 130 at appropriate timing by determining the state of the waste toner container 130 depending on the detected waste toner amount or the driving force and providing notifications depending on to the determination result.

Fourth Embodiment

Figure 20:
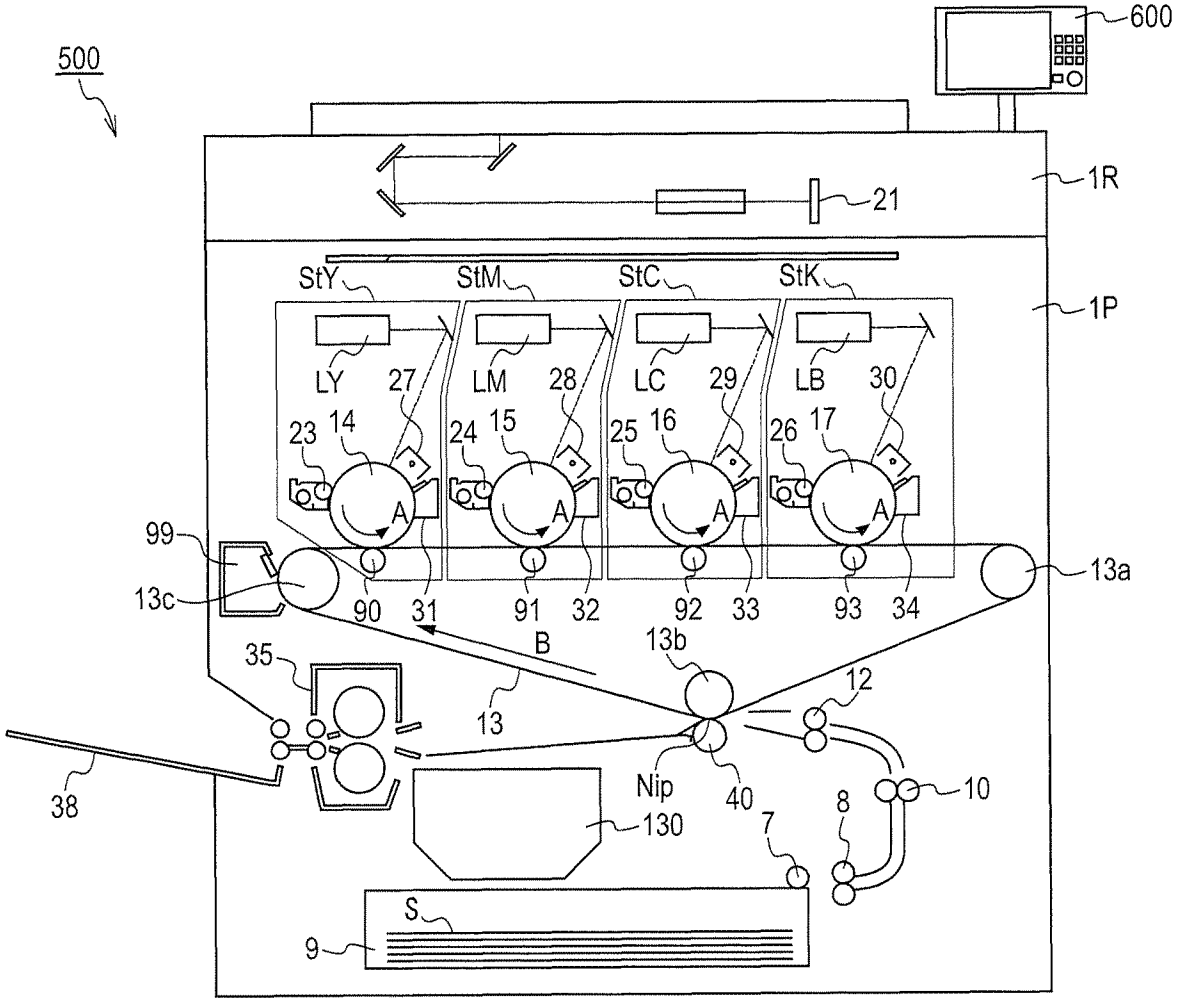
FIG. 20 is a schematic cross-sectional view of the image forming apparatus.

FIG. 20 is a schematic cross-sectional view of an image forming apparatus 500 according to a fourth embodiment. The image forming apparatus 500 comprises an operation panel 600, a reader unit 1R, and a printer unit 1P.

The printer unit 1P comprises four image forming units StY, StM, StC, and StK, for forming an image of each color component (toner image). The image forming unit StY forms a yellow toner image. The image forming unit StM forms a magenta toner image. The image forming unit StC forms a cyan toner image. The image forming unit Stk forms a black toner image.

The image forming unit StY comprises a photosensitive drum 14 which carries the toner image of the color component of yellow, a charger 27 which charges the photosensitive drum 14, and an exposure device LY which exposes the photosensitive drum 14 for forming an electrostatic latent image corresponding to the color component of yellow on the photosensitive drum 14. Further, the image forming unit StY comprises a developing device 23 and a primary transfer roller 90. The developing device 23 develops the electrostatic latent image formed on the photosensitive drum 14 as the toner image using toner as developer. The primary transfer roller 90 transfers the toner image formed on the photosensitive drum 14 to an intermediate transfer belt 13 (described later).

Further, the image forming unit StY comprises a drum cleaner 31 which removes toner remaining on the photosensitive drum 14 without being transferred to the intermediate transfer belt 13. The drum cleaner 31 comprises a cleaner blade consisting of a plate-like rubber member. When the photosensitive drum 14 rotates in an arrow A direction in a state in which the cleaner blade is brought into contact with the photosensitive drum 14 with predetermined force, the drum cleaner 31 can sweep the toner remaining on the photosensitive drum 14. This means that the drum cleaner 31 functions as a cleaning unit which cleans the toner remaining on the photosensitive drum 14 as an image carrier. It is noted that the toner having swept by the drum cleaner is then conveyed to a waste toner container 130 through a waste toner conveyance path (not shown).

Here, each of the image forming units StM, StC, and StK is similarly configured as the image forming unit StY, which forms the yellow toner image, so their description is omitted with regard to the configuration.

The intermediate transfer belt 13 as mentioned is an intermediate transfer body on which the toner image is carried. By overlappingly transferring the toner images of each color component formed in the image forming units StY, StM, StC, and Stk to the intermediate transfer belt 13, a full color toner image is carried. The intermediate transfer belt 13 is an image carrier which carries the image formed by each image forming unit StY, StM, StC, and StK. A secondary transfer opposite roller 13*b* and a secondary transfer roller 40, for transferring the toner image formed on the intermediate transfer belt 13 to a recording medium S, such as a sheet, are arranged around the intermediate transfer belt 13. Further, the intermediate transfer belt 13 is tensioned by a driving roller 13*a*, the secondary transfer opposite roller 13*b*, and a driven roller 13*c*. The intermediate transfer belt 13 moves in an arrow B direction through rotation of the driving roller 13*a*.

Further, a belt cleaner 99 is arranged on the intermediate transfer belt 13. The belt cleaner 99 removes the toner which remains without being transferred from the intermediate transfer belt 13 to the recording medium S. Similar to the drum cleaner 31, the belt cleaner 99 also comprises a cleaner blade consisting of a plate-like rubber member. When the intermediate transfer belt 13 rotates in the arrow B direction in a state in which the cleaner blade is brought into contact with the intermediate transfer belt 13 with predetermined force, the belt cleaner 99 can sweep the toner remaining on the intermediate transfer belt 13. This means that the belt cleaner 99 which cleans the toner remaining on the intermediate transfer belt 13 also functions as the cleaning unit. It is noted that, in the present embodiment, the toner having swept by the belt cleaner 99 also passes through the waste toner conveyance path (not shown) and is recovered into the waste toner container 130. The waste toner container 130 functions as an accumulation container used to accumulate the toner recovered by the belt cleaner 99. Further, the belt cleaner 99 is not limited to the configuration of bringing the plate-like cleaner blade into contact with the intermediate transfer belt 13 with predetermined force. It may, for example, be configured to bring the belt cleaner 99 into contact with the intermediate transfer belt 13 while rotating a brush-like cleaning member.

A fixing unit 35, comprising a heating roller and a pressurizing roller, fixes the toner image carried on the recording medium S by heat and pressure.

The operation panel 600 comprises a numeric keypad used to input the number of image forming sheets and the like, a copy button for starting the image formation, a mode selection button used to set various print modes such as one-sided printing, double-sided printing and the like, and a liquid crystal display on which guidance for assisting various operations of the image forming apparatus 500 can be displayed. It is noted that the liquid crystal display is a touch panel.

In the reader unit 1R, when the user places an original on a platen and the user presses the copy button on the operation panel 600, light is irradiated on the original. Then, the light reflected from the original is received by an image sensor 21 through a reflection mirror. The image sensor 21 obtains the reflected light from the original as a luminance signal of red, blue, and green by a color filter. A CPU 101 (FIG. 22) applies known image processing to the luminance signals obtained by the image sensor 21. Then, the luminance signals are converted into image data for forming the toner image for each color component of yellow, magenta, cyan, and black.

Figure 22:
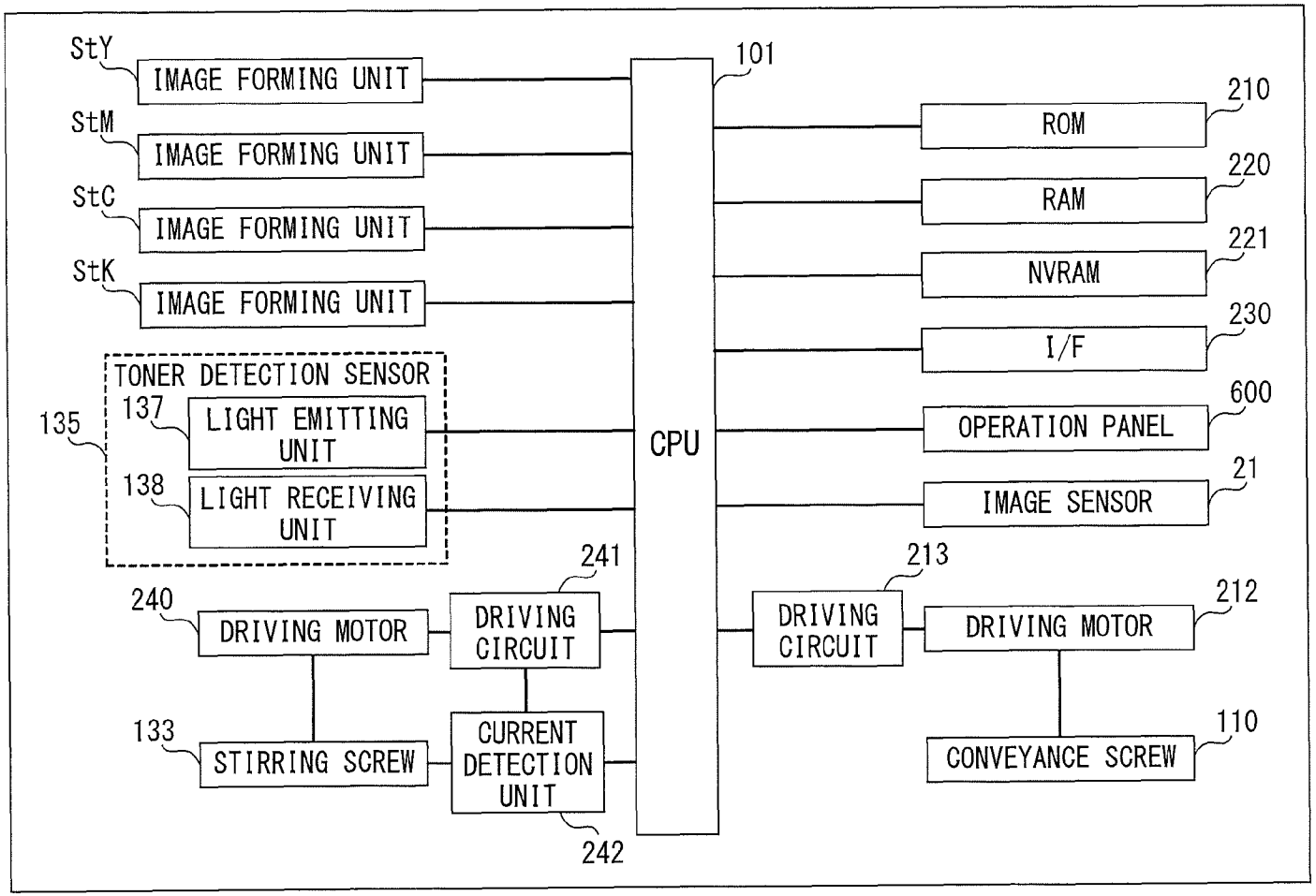
FIG. 22 is a control block diagram of the image forming apparatus.

Here, the image forming apparatus 500 is configured to obtain the image data by reading, by the reading unit 1R, the original. The image forming apparatus 500 is also configured such that the image data is transferred from an external device such as a scanner or PC which is communicably connected to the image forming apparatus 500 via an I/F 230 (FIG. 22).

Next, a description is provided with regard to an image forming operation in which the printer unit 1P forms an image corresponding to the image data.

In the image forming unit StY, a surface of the photosensitive drum 14 is uniformly charged by the charger 27. The exposure device LY exposes a laser beam modulated according to the image data corresponding to yellow on the photosensitive drum 14. Thereby, an electrostatic latent image corresponding to the color component of yellow of the image data is formed on the surface of the photosensitive drum 14.

Then, the electrostatic latent image formed on the surface of the photosensitive drum 14 is developed by the toner of the developing device 23. Thereby, the toner image corresponding to the color component of yellow is carried on the photosensitive drum 14. Along with the rotation of the photosensitive drum 14 in the arrow A direction, the toner image of the color component of yellow is conveyed to a primary transfer unit where the primary transfer roller 90 pressurizes the photosensitive drum 14 through the intermediate transfer belt 13. When the toner image of the color component of yellow formed on the photosensitive drum 14 passes through the primary transfer unit while a transfer voltage is being applied to the primary transfer roller 90, the toner image of the color component of yellow is transferred to the intermediate transfer belt 13. It is noted that, through the processing similar to that which the image forming unit StY forms the image of the color component of yellow, the image forming units StM, StC, and StK also form the image of each color component on photosensitive drums 15, 16, and 17, respectively, using exposure devices LM, LC, and LB, developing devices 24, 25, 26, chargers 28, 29, 30, and primary transfer rollers 91, 92, 93.

By overlappingly transferring the toner images corresponding to each color component of the image data in order to the intermediate transfer belt 13 by the image forming units StY, StM, StC, and Stk, a full color toner image is formed on the intermediate transfer belt 13.

Along with the movement of the intermediate transfer belt 13 in the arrow B direction, the full color toner image carried on the intermediate transfer belt 13 is conveyed to a secondary transfer unit Nip where the secondary transfer roller 40 pressurizes the secondary transfer opposite roller 13*b* through the intermediate transfer belt 13. At this time, the recording medium S stored in a sheet feeding cassette 9 is fed one by one through a pick up roller 7 and a sheet feeding roller pair 8 and conveyed to the secondary transfer unit Nip through the sheet feeding roller pair 8 and a conveyance roller pair 10. The recording medium S having been conveyed through the sheet feeding roller pair 8 and the conveyance roller pair 10 is then adjusted in its sheet position and delivery timing by a registration roller 12. Then, the recording medium S is supplied to the secondary transfer unit Nip so as to be brought into contact with the toner image formed on the intermediate transfer belt 13.

When the toner image formed on the intermediate transfer belt 13 and the recording medium S having been delivered from the registration roller 12 enter the secondary transfer unit Nip, a transfer voltage is applied to the secondary transfer roller 40. Then, a transfer electric field is formed between the secondary transfer opposite roller 13*b* and the secondary transfer roller 40. Thereby, the toner image formed on the intermediate transfer belt 13 is transferred to the recording medium S. The recording medium S having the toner image transferred at the secondary transfer unit Nip is then conveyed to the fixing unit 35. In the fixing unit 35, the toner image is fixed on the recording medium S. This is done by heating the recording medium S by a heater provided in the heating roller while the recording medium S is being nipped and conveyed by the heating roller and the pressurizing roller. Thereafter, the recording medium S having the toner image fixed thereon is discharged to a sheet discharge tray 38.

Figure 21A:
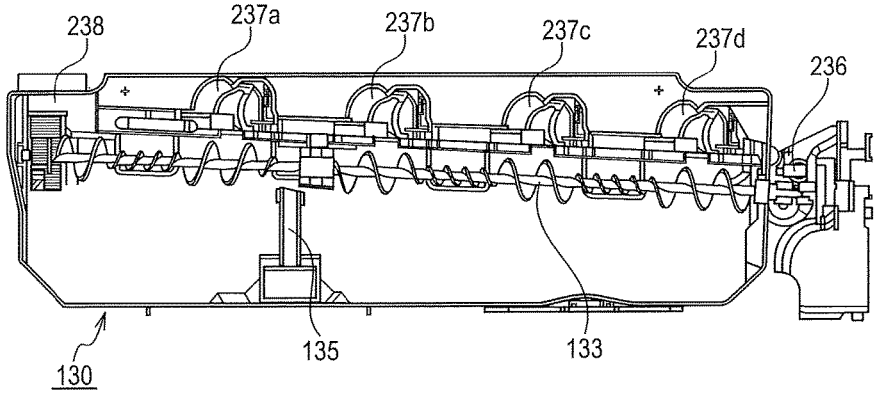
FIGS. 21A, 21B, and 21C are schematic cross-sectional diagrams of the waste toner container.
Figure 21B:
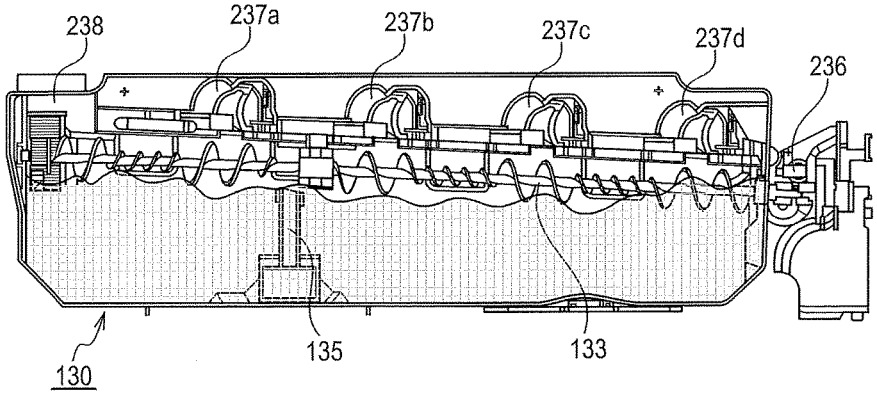
Figure 21C:
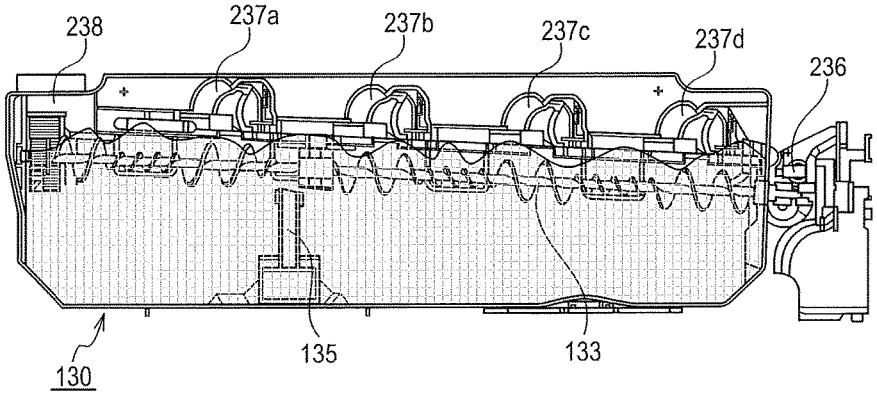

A description of a configuration of the waste toner container 130 which is attachably/detachably mounted to/from the image forming apparatus 500 is provided based on FIG. 21A to FIG. 21C. It is noted that the waste toner container 130 comprises the stirring screw 133 as a rotating member which rotates to move the toner accumulated in the waste toner container 130. A screw flag 236, provided on the same rotating axis as the stirring screw 133, is a transmission member which transmits, by engaging with a pin which rotates by a driving motor 240 (FIG. 22), driving force of the driving motor 240 to the stirring screw 133. Thereby, the stirring screw 133 is rotationally driven by the driving motor 240 (FIG. 22).

The toner having been cleaned by drum cleaners 31, 32, 33, and 34 is then conveyed along a waste toner conveyance path (not shown) while a conveyance screw 110 (FIG. 22) provided in the waste toner conveyance path is rotating. The toner having been conveyed by the conveyance screw 110 is discharged to the waste toner container 130 from receiving ports 237*a*, 237*b*, 237*c*, and 237*d* of the waste toner container 130. The waste toner container 130 functions as an accumulation container used to accumulate the toner recovered by the drum cleaners 31, 32, 33, and 34.

Also, the toner having been cleaned by the belt cleaner 99 is discharged to the waste toner container 130 through a waste toner conveyance path which is different from the waste toner conveyance path for the toner cleaned by the drum cleaners 31, 32, 33, and 34. The toner having been cleaned by the belt cleaner 99 is discharged to the waste toner container 130 from a receiving port 238. The waste toner container 130 receives the toner from five receiving ports in total, i.e., the receiving ports 237*a*, 237*b*, 237*c*, 237*d*, and 238.

FIG. 21A represents a state in which the toner is not accumulated in the waste toner container 130. FIG. 21B represents a state in which the toner equivalent to 95 [%] of capacity of the waste toner container 130 is accumulated. FIG. 21C represents a state in which the waste toner container 130 is fully loaded. It is noted that, during the image forming operation, the waste toner is constantly delivered little by little. So, it is controlled such that the stirring screw 133 constantly rotates while at least one of the photosensitive drums 14, 15, 16, and 17 rotates.

The toner having freely dropped from the receiving ports 237*a*, 237*b*, 237*c*, 237*d*, and 238 into the waste toner container 130 is easily accumulated directly below the receiving ports 237*a*, 237*b*, 237*c*, and 237*d*. While changing from the state shown in FIG. 21A to the state shown in FIG. 21B, the toner is accumulated in a shape of a mountain directly below the receiving ports 237*a*, 237*b*, 237*c*, 237*d* and 238.

When the toner accumulated in the waste toner container 130 contacts the stirring screw 133, through the rotation of the stirring screw 133, the piled toner falls down. Then, through the rotation of the stirring screw 133 for 2 to 5 seconds, the surface of the toner accumulated in the waste toner container 130 is uniformly leveled as shown in FIG. 21B. Through the rotation, the stirring screw 133 moves the toner accumulated directly below the receiving ports 237*a*, 237*b*, 237*c*, 237*d* and 238. Thereby, the waste toner container 130 can accumulate the toner in the waste toner container 130 effectively.

At this time, when the toner enters the toner detection sensor 135 from an opening of the toner detection sensor 135 provided in the waste toner container 130, the toner detection sensor 135 detects that the toner amount accumulated in the waste toner container 130 is more than the predetermined amount. It is noted that the detail of the toner detection sensor 135 is already described in FIG. 7 and FIG. 8. Then, as shown in FIG. 21C, when the waste toner container 130 is fully loaded, the stirring screw 133 is buried in the toner. In this state, a load torque becomes the highest. The image forming apparatus 500 can form the image of a predetermined number of pages until the waste toner container 130 is fully loaded as shown in FIG. 21C after the waste toner is detected by the toner detection sensor 135 in FIG. 21B. Then, the image forming apparatus 500 prohibits execution of the image forming operation after the number of image forming pages reaches the predetermined number of pages after the waste toner is detected by the toner detection sensor 135. It is noted that the predetermined number of pages may be determined in advance by an experiment.

By the way, even in a state in which the toner amount in the waste toner container 130 does not reach 95[%] of the capacity of the waste toner container 130, if the waste toner container 130 is shaken, the toner in the waste toner container 130 enters from the opening of the toner detection sensor 135. Thereby, the toner detection sensor 135 may wrongly detect that the toner is accumulated in the toner detection sensor 135. Therefore, in the present embodiment, the CPU 101 (FIG. 22) controls whether or not to provide a notification indicating the replacement of the waste toner container 130 using driving information of the stirring screw 133, in addition to the accumulation information detected by the toner detection sensor 135.

In a case where the height of the waste toner accumulated in the waste toner container 130 is higher than the height of a sidewall of the toner detection sensor 135, the toner detection sensor 135 is configured such that the toner is flown inside from the opening provided on an upper side of the toner detection sensor 135. The height of the toner detection sensor 135 is so determined that, when the toner equal to or more than 95 [o] of the capacity of the waste toner container 130 is accumulated, the waste toner accumulated in the waste toner container 130 enters the toner detection sensor 135.

If the waste toner is accumulated in the toner detection sensor 135, the light receiving amount of the light receiving unit 138 reduces. The light receiving unit 138 has a feature in that when the light receiving amount reduces, an output voltage Vsns increases. When the output voltage Vsns becomes higher than a threshold value by the reduction of the light receiving amount of the light receiving unit 138, it is detected that the waste toner accumulated in the waste toner container 130 is more than the predetermined amount. Then, if the output voltage Vsns of the light receiving unit 138 of the toner detection sensor 135 exceeds the threshold value (for example, 1.65 [V]), a message, prompting the user to replace the waste toner container 130 (FIG. 25A), is displayed on the liquid crystal screen of the operation panel 600.

FIG. 26 is a diagram showing the relation of the filling ratio of the waste toner container 130 and the output voltage Vsns of the light receiving unit 138 in a case where the light emitting unit 137 is made to emit light at high light amount. First, a description is provided with regard to a change of the output voltage Vsns in a case where the toner detection sensor 135 is not contaminated with the toner. In a case where the filling ratio of the waste toner in the waste toner container 130 reaches 90 [%], the waste toner in the waste toner container 130 flows into the toner detection sensor 135 little by little. Thereby, the output voltage Vsns increases. Then, when the filling ratio of the waste toner in the waste toner container 130 reaches 95 [%], the output voltage Vsns reaches the threshold value of 1.65[V].

On the other hand, the following describes a change of the output voltage Vsns in a case where the toner detection sensor 135 is contaminated with the toner. In a case where the toner detection sensor 135 in the waste toner container 130 is contaminated, the light receiving amount of the light receiving unit 138 reduces due to the contamination of the toner detection sensor 135. So, before the filling ratio of the waste toner in the waste toner container 130 reaches 90[%], the output voltage Vsns reaches a value which is higher than 1.65[V]. Because the output voltage Vsns is higher than 1.65 [V], the CPU 101 prompts the user to replace the waste toner container 130 even though the waste toner container 130 can still have room to accumulate the waste toner. This causes the user to unnecessarily replace the waste toner container 130, so it is likely that usability is deteriorated.

Thereby, in the present embodiment, the CPU 101 causes the light emitting unit 137 to emit light at a low light amount and determines whether the output voltage Vsns is higher than 1.65 [V] or not. It is noted that the light amount of the light emitting unit 137 is set such that the output voltage Vsns becomes less than 1.65 [V] when the light emitting unit 137 emits light at the low light amount in a case where the filling ratio of the toner in the waste toner container 130 is less than 90 [%] and the toner detection sensor 135 is not contaminated with the toner.

Due to the contamination of the toner detection sensor 135, the output voltage Vsns becomes higher than 1.65 [V]. So, in a case where the output voltage Vsns is higher than 1.65 [V] when the CPU 101 causes the light emitting unit 137 to emit light at the low light amount, the CPU 101 causes the light emitting unit 137 to emit light at a high light amount and determines whether the output voltage Vsns is higher than 1.65 [V] or not. The reason why the CPU 101 does not cause the light emitting unit 137 to emit light at the high light amount from the beginning is to prevent component service life of the light emitting element 137 from being shortened. Thereby, it is possible to prevent the component service life of the light emitting unit 137 from being shortened. It is also possible to prevent the user from being prompted to replace the waste toner container 130 even in a state in which the waste toner container 130 can still have room to accumulate the toner.

In the present embodiment, the toner detection sensor 135 is an optical sensor. The toner detection sensor 135, however, is not limited to the optical sensor. For example, the toner detection sensor 135 may be a sensor utilizing ultrasonic waves, an inductance sensor utilizing the fact that the dielectric constant of the toner is higher than that of air, a piezo sensor utilizing a change of a resonance frequency of a piezoelectric element provided only on a position which contacts the waste toner accumulated in the toner detection sensor 135, and the like. Also, in the image forming apparatus 500, a sensor which detects whether the waste toner container 130 has been replaced or not (not shown) is separately provided. The sensor which detects whether the waste toner container 130 has been replaced or not may be a known sensor, so its detail description is omitted.

FIG. 22 is a control block diagram of the image forming apparatus 500.

The CPU 101 is a control circuit for entirely controlling the image forming apparatus 500. In a ROM 210, a control program for executing, by the CPU 101, various processings to operate the image forming apparatus 500 is stored. A RAM 220 is a system work memory for the CPU 101 to operate. In an NVRAM 221, flag information used in control (described later) is stored. The I/F 230 is an interface for outputting an image data input from an external device such as a PC to the CPU 101. The description has already been provided with regard to the image forming units StY, StM, StC, and StK, the operation panel 600 and the image sensor 21 in FIG. 20 as mentioned, so the respective description is omitted here.

The driving motor 240 is a DC motor which rotationally drives the stirring screw 133 via a gear. The driving motor 240 is driven with a predetermined driving voltage. The predetermined driving voltage is, for example, 24 [V]. It is noted that the driving motor 240 may be other types of motors, such as a brushless motor. In response to an input of a command to rotate the stirring screw 133 from the CPU 101, a driving circuit 241 applies the predetermined driving voltage to the driving motor 240.

A current detection unit 242 detects a current value flown into the driving motor 240 while the driving circuit 241 drives the driving motor 240. When the load torque caused by the resistance for preventing the rotation of the stirring screw 133 by the waste toner accumulated in the waste toner container 130 increases, the current value of the driving motor 240 increases. The current value of the driving motor 240 corresponds to driving information.

Figure 23:
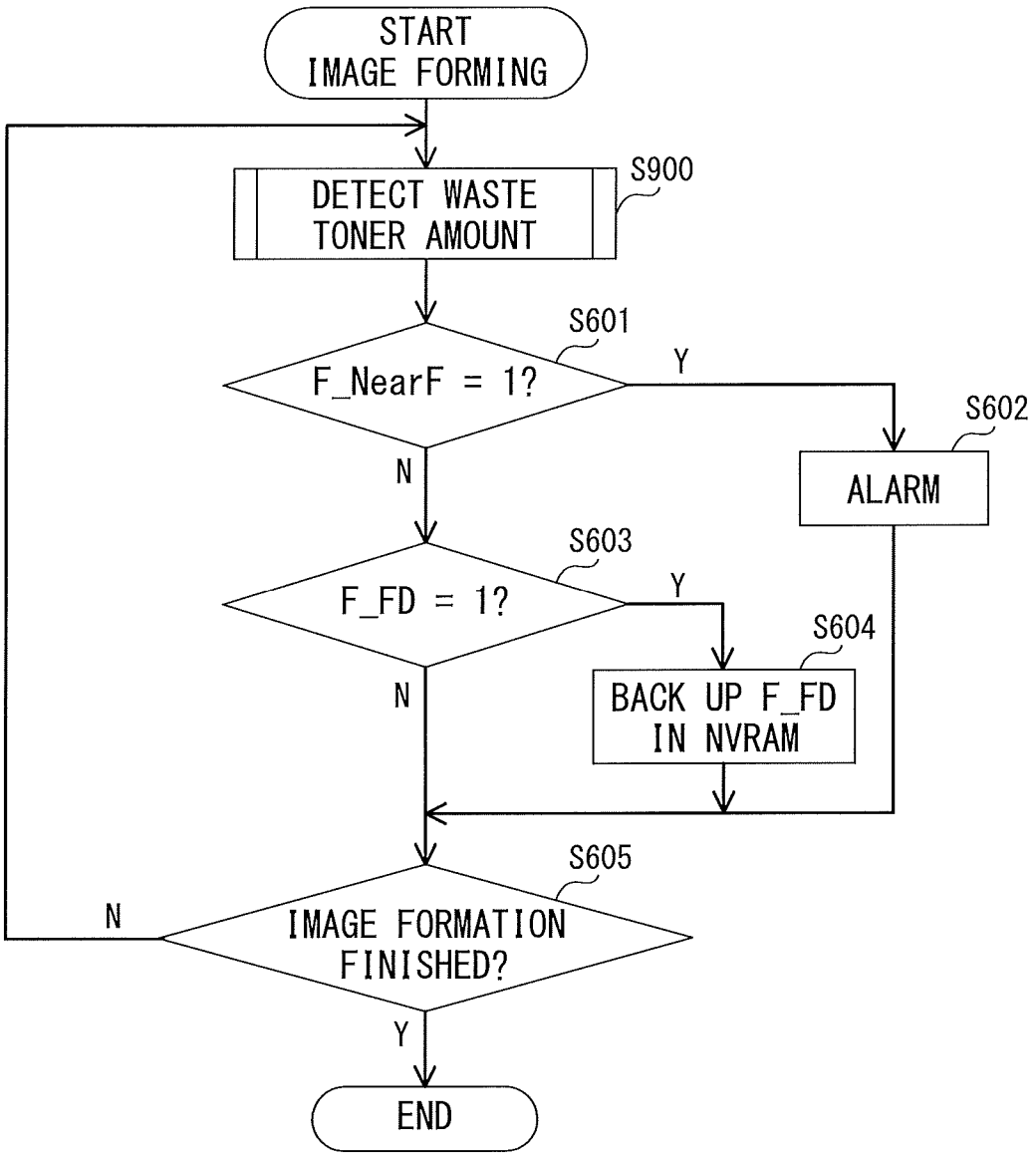
FIG. 23 is a flowchart showing image forming processing.

Next, a description is provided with regard to image forming processing of the image forming apparatus 500 based on FIG. 23.

In a case where the image is formed based on the image data transferred through the I/F 230, the CPU 101 executes waste toner amount detection processing (S900). In the waste toner amount detection processing, the CPU 101 determines whether the filling ratio of the waste toner container 130 is higher than 95 [o] or not. If it is determined that the filling ratio of the waste toner container 130 is higher than 95 [%], the CPU 101 sets a value of F_NearF flag to "1". Further, in the waste toner amount detection processing, the CPU 101 determines whether the toner detection sensor 135 is making wrong detection or not. If it is determined that the toner detection sensor 135 is making wrong detection, the CPU 101 sets a value of F_FD flag to "1".

After executing the waste toner amount detection processing, the CPU 101 determines whether to inform a message prompting a user to replace the waste toner container 130 (FIG. 25A) or not (S601). In the processing of S601, in a case where the value of F_NearF flag, which represents whether the filling ratio of the waste toner container 130 is higher than 95[%] or not, is "1", the CPU 101 informs the user that the toner amount accumulated in the waste toner container 130 is more than a predetermined amount (S602).

In the processing of S602, the CPU 101 displays a message on the liquid crystal display of the operation panel 600 as shown in FIG. 25A, informing the user that time to replace the waste toner container 130 is close. In the processing of S602, if the message is displayed, the CPU 101 sets a value of a counter (not shown) to "0". Then, the CPU 101 increases "1" counter value every time the image forming operation of 1 page is executed. Then, after the value of the counter reaches the predetermined value, the CPU 101 displays a message on the liquid crystal display of the operation panel 600, indicating that it is time to replace the waste toner container 130 as shown in FIG. 25B. Then, the CPU 101 prohibits the execution of the image forming operation until the waste toner container 130 is replaced with a waste toner container 130 which is empty. In the processing of S602, the operation panel 600 functions as a notification unit which provides a notification indicating time to replace the waste toner container 130.

On the other hand, in the processing of S601, in a case where the value of F_NearF flag is "0", the CPU 101 determines that the toner amount accumulated in the waste toner container 130 is less than the predetermined amount. Then, the CPU 101 determines whether the toner detection sensor 135 made wrong detection due to the contamination of the toner (S603). In the processing of S603, in a case where the value of the F_FD flag, which shows whether the toner detection sensor 135 has made wrong detection or not, is "1", the CPU 101 stores the value of the F_FD flag in the NVRAM 221 (S604).

It is noted that in the processing of S604, the CPU 101 can also store, for example, time data and data regarding the number of printed sheets together. Storage of the fact that the toner detection sensor 135 made wrong detection allows a serviceman to know when he maintains the image forming apparatus 500 that the wrong detection has occurred due to the contamination of the toner detection sensor 135. For example, the serviceman may clean the toner detection sensor 135 based on information of the F_FD flag stored in the NVRAM 221.

On the other hand, in the processing of S603, in a case where the value of the F_FD flag is "0", the CPU 101 determines that the toner detection sensor 135 is not contaminated. Then, the CPU 101 determines whether all images are finished to be formed based on the image data transferred (S605). In the processing of S605, if it is determined that all images are finished to be formed, the CPU 101 ends the image forming processing.

On the other hand, in the processing of S605, if it is determined that all images are not finished to be formed, the CPU 101 forms the next image and then moves to the processing of S900 to execute the waste toner amount detection processing. The CPU 101 repeatedly executes the waste toner amount detection processing while executing the image forming operation.

Figure 24:
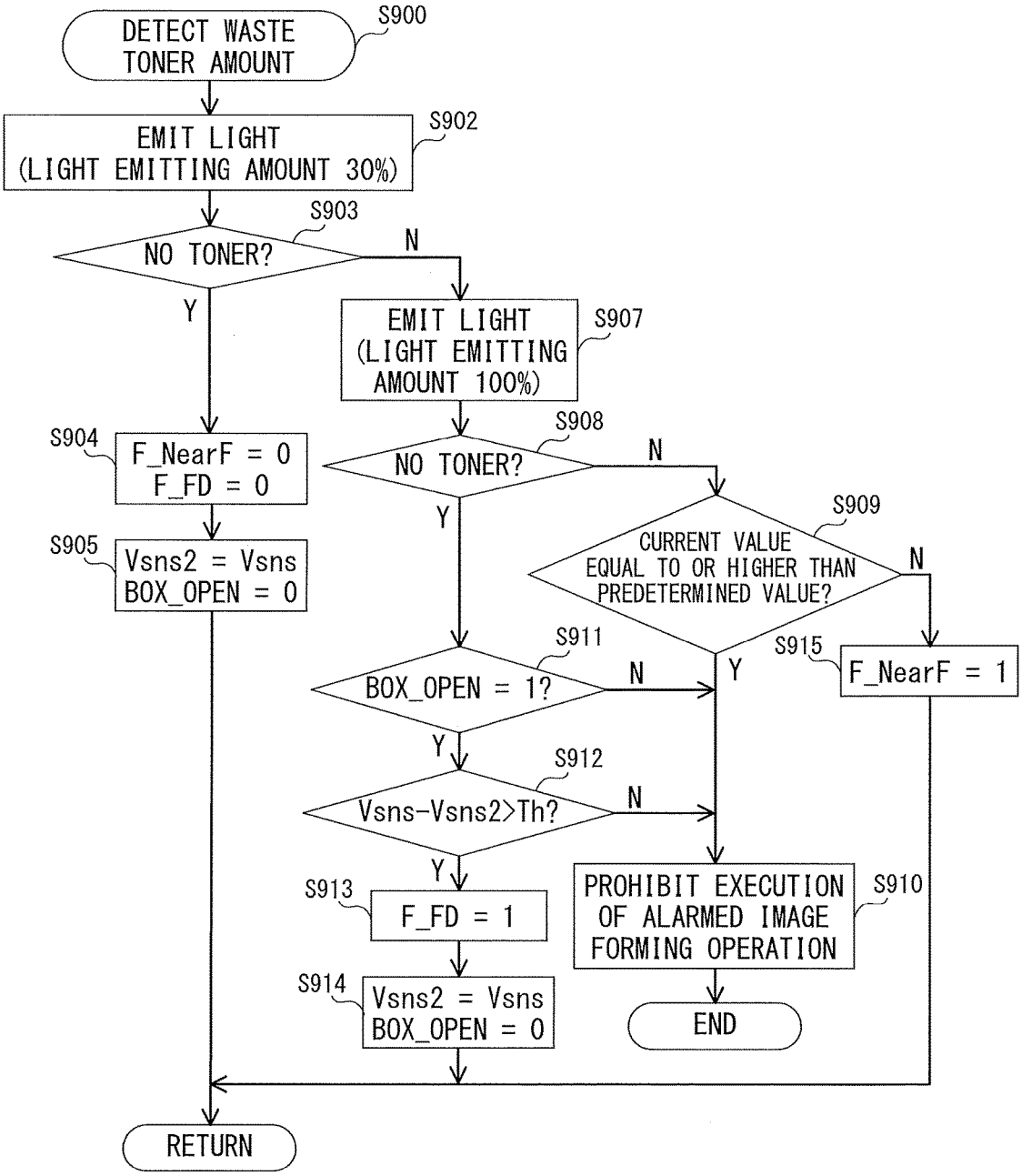
FIG. 24 is a flowchart diagram showing waste toner amount detection processing.

Next, a description is provided in detail with regard to the waste toner amount detection processing of S900 based on FIG. 24.

In the waste toner amount detection processing, the CPU 101 first causes the light emitting unit 137 to irradiate light of a first light amount (30 [%] of the maximum light emitting amount) (S902). The reason why the light emitting unit 137 does not irradiate light of the maximum light emitting amount in the processing of S902 is because it is desired to prolong the lifetime of the light emitting unit 137 as much as possible. The CPU 101 determines whether accumulation information indicating that the waste toner amount in the waste toner container 130 is more than the predetermined amount is detected by the toner detection sensor 135 or not (S903). In the processing of S903, the CPU 101 compares the output voltage Vsns of the light receiving unit 138 with the threshold value (1.65 [V]).

In the processing of S903, if it is determined that the output voltage Vsns of the light receiving unit 138 is lower than 1.65 [V], the CPU 101 determines that the toner amount in the waste toner container 130 is less than the predetermined amount. Then, the CPU 101 sets the F_NearF flag and the F_FD flag to an initial value (0) (S904). The F_NearF flag indicates whether the filling ratio of the waste toner container 130 is higher than 95 [%] or not. The F_FD flag indicates whether the toner detection sensor 135 is making wrong detection or not. Then, the CPU 101 stores the output voltage value Vsns of the light receiving unit 138 obtained in the processing of S903 in the NVRAM 221 and sets the value of the BOX_OPEN flag to a predetermined value (0) (S905). Then, the CPU 101 ends the waste toner amount detection processing. It is noted that the output voltage stored in the NVRAM 221 is referred to as an output voltage Vsns2.

Here, the BOX_OPEN flag represents flag information for identifying whether the waste toner container 130 has been removed or not. After the main power supply of the image forming apparatus 500 is turned ON, and when it is detected that a state is changed from a state in which the waste toner container 130 has been removed to a state in which the waste toner container 130 is mounted, the CPU 101 sets the value of BOX_OPEN flag to "1". The reason why the value of the BOX_OPEN flag is set to "1" after the main power supply of the image forming apparatus 500 is turned ON is because the CPU 101 cannot detect whether the waste toner container 130 has been replaced or not while the main power supply of the image forming apparatus 500 is being turned OFF. Then, in a case where the toner amount in the waste toner container 130 is less than the predetermined amount and it is determined that the toner detection sensor 135 is not contaminated, the CPU 101 determines that the waste toner container 130 is not replaced. Thereby, the CPU 101 changes the value of the BOX_OPEN flag to the predetermined value (0) in the Step S905.

On the other hand, in the processing of S903, in a case where the output voltage Vsns of the light receiving unit 138 is higher than 1.65[V], the CPU 101 causes to increase the light emitting amount of the light emitting unit 137 and detects again the accumulation information of the waste toner in the waste toner container 130. The CPU 101 causes the light emitting unit 137 to irradiate light of a second light amount (maximum light emitting amount, 100 [%]) (S907). Then, the CPU 101 determines whether or not the toner detection sensor 135 has detected the accumulation information indicating that the waste toner amount in the waste toner container 130 is more than the predetermined amount (S908). In the processing of S908, the CPU 101 compares the output voltage Vsns of the light receiving unit 138 with the threshold value.

In the processing of S908, if it is determined that the output voltage Vsns of the light receiving unit 138 is higher than 1.65 [V], the CPU 101 determines whether the waste toner accumulated in the waste toner container 130 is more than the predetermined amount. Then, the CPU 101 determines whether the current value of the driving motor 240 detected by the current detection unit 242 is equal to or higher than the predetermined value or not (S909). In a case where the filling ratio of the toner in the waste toner container 130 is more than 95[%], it means that the stirring screw 133 is buried in the waste toner so that the current value of the driving motor 240 becomes larger than the predetermined value. The current value of the driving motor 240 is, for example, 0.8 [A].

In the processing of S909, if it is determined that the current value of the driving motor 240 is larger than 0.8 [A], the CPU 101 determines that the waste toner container 130 is full of the toner. Then, the CPU 101 displays the message shown in FIG. 25B on the liquid crystal display of the operation panel 600 (S910). Here, a target value (target information) of the current value of the driving motor 240 is 0.8 [A]. In a case where the current value of the driving motor 240 is larger than 0.8 [V], the CPU 101 functions as a control unit which displays the message shown in FIG. 25B on the liquid crystal display of the operation panel 600.

Then, the CPU 101 prohibits the execution of the image forming operation until the waste toner container 130 is replaced with a waste toner container 130 which is empty. Then, the CPU 101 ends the waste toner amount detection processing. In the processing of S910, the operation panel 600 functions as a notification notifying unit which provides notification of time to replace the waste toner container 130.

On the other hand, in the processing of S909, if it is determined that the current value of the driving motor 240 is smaller than 0.8 [A], the CPU 101 determines that the filling ratio of the waste toner container 130 is larger than 95 [%] but it is not fully loaded. In the processing of S909, if it is determined that the driving current value of the driving motor 240 is smaller than 0.8 [A], the CPU 101 sets the value of the F_NearF flag to "1" (S915). Then, the CPU 101 ends the waste toner amount detection processing.

In the processing of S908, if it is determined that the output voltage Vsns of the light receiving unit 138 is lower than 1.65 [V], the CPU 101 determines that the load torque of the driving motor 240 is small and there is a high possibility that the toner detection sensor 135 of the waste toner container 130 is contaminated with the waste toner. It is noted that, other than the fact that the toner detection sensor 135 is contaminated with the waste toner, there is a high possibility that some abnormality is occurring. So, in a case where it is determined that there is a high possibility that some abnormality is occurring, the CPU 101 prohibits the execution of the image forming operation and prompts the user to replace the waste toner container 130. Thereby, even in a case where the output voltage Vsns of the light receiving unit 138 is lower than 1.65 [V], the CPU 101 determines whether there is a possibility that abnormality is occurring or not through the processing of S911 and S912.

In the processing of S908, if it is determined that the output voltage Vsns of the light receiving unit 138 is lower than 1.65 [V], the CPU 101 determines whether it is immediately after the removal of the waste toner container 130 or not. It means that the CPU 101 determines whether the value of the BOX_OPEN flag is "1" or not (S911). If it is determined that the value of the BOX_OPEN flag is not "1", meaning that the value of the BOX_OPEN flag is "0", the CPU 101 determines that it is not immediately after the removal of the waste toner container 130. Then, in spite of the fact that it is not immediately after the replacement of the waste toner container 130, the fact that the toner amount in the waste toner container 130 is more than the predetermined amount is detected by the toner detection sensor 135. So, the CPU 101 determines that abnormality is occurring and moves to the processing of S910.

Thereby, if it is determined that there is a high possibility that abnormality is occurring, the CPU 101 can prohibit the execution of the image forming operation and prompt the user to replace the waste toner container 130. At this time, for example, if the information indicating that there is a possibility that some abnormality is occurring in the NVRAM 221, the serviceman can know that it is not because the waste toner container 130 is fully loaded that the image forming operation is prohibited. This allows the serviceman to know that it is required to replace or fix the apparatus instead of a replacement operation of the waste toner container 130.

On the other hand, in the processing of S911, if it is determined that the value of the BOX_OPEN flag is "1", the CPU 101 determines that it is immediately after the replacement of the waste toner container 130. Then, the CPU 101 determines whether the difference between the previous output voltage Vsns2 and the output voltage Vsns of this time stored in the NVRAM 211 is larger than the predetermined value or not (S912). If it is determined that the difference between the previous output voltage Vsns 2 and the output voltage Vsns of this time is larger than the predetermined value, it means that the output voltage value of the light receiving unit 138 has rapidly changed immediately after the replacement of the waste toner container 130. It means that the CPU 101 functions as a determination notifying unit which determines variation between the voltage Vsns detected at first timing and the voltage Vsns2 detected at second timing which is prior to the first timing.

In a case where it is immediately after the replacement of the waste toner container 130 and the output voltage of the light receiving unit 138 has rapidly changed, the CPU 101 determines that the waste toner container 130 has been shaken at the time of replacing the waste toner container 130 and the toner detection sensor 135 is contaminated with the toner. Then, the CPU 101 sets the value of the F_FD flag to "1" (S913) and stores information indicating that the toner detection sensor 135 is making wrong detection in the NVRAM 221.

After setting the value of the F_FD flag to "1" in the processing of S913, the CPU 101 stores the output voltage Vsns of the light receiving unit 138 obtained in the processing of S908 in the NVRAM 221. The CPU 101 also sets the value of the BOX_OPEN flag to the predetermined value (0) (S914), and then the CPU ends the waste toner amount detection processing.

On the other hand, in the processing of S912, if it is determined that the difference between the previous output voltage Vsns2 and the output voltage Vsns of this time is smaller than the predetermined value, the CPU 101 determines that there is a high possibility that some abnormality is occurring. Then, the CPU 101 moves to the processing of S910.

It is noted that in the present embodiment, in a case where there is a high possibility that some abnormality is occurring, the CPU 101 prohibits the execution of the image forming operation. The CPU 101, however, may set the value of the F_nearF flag to "1" in a case where there is a high possibility that some abnormality is occurring. With this configuration, even in a case where it is determined that there is a high possibility that some abnormality is occurring, the image forming operation can be continued until the number of printed sheets reaches the predetermined value, which enables to reduce unnecessary replacement of the waste toner container 130.

It is noted that, in the present embodiment, the driving motor 212 is controlled by a constant voltage. Instead, the driving motor 212 may be controlled by a constant current. With this configuration, instead of the current detection unit 242, a voltage detection unit is provided. Then, in a case where a voltage value of the driving motor detected by the voltage detection unit is higher than the predetermined value, the CPU 101 may provide the information to the user indicating that the waste toner container 130 is fully loaded.

Alternatively, supplied power of the driving motor 212 may be controlled to reach a predetermined rotation speed by a driving circuit 213. With this configuration, a detection apparatus for detecting the rotation speed of the driving motor 212 is provided. Then, in a case where the rotation speed of the driving motor 212 is lower than the target speed, the CPU 101 may provide the notification to the user indicating that the waste toner container 130 is fully loaded. When the waste toner container 130 is fully loaded, the load torque of the stirring screw 133 becomes large so that the rotation speed of the driving motor 212 becomes lower than the target speed. Then, in a case where the rotation speed of the stirring screw 133 is reduced by the predetermined value or more than the target speed, the CPU 101 may determine that the waste toner container 130 is fully loaded.

As previously mentioned, according to the image forming apparatus of the present disclosure, it is possible to suppress the wrong detection of the accumulation information of the waste toner container 130 due to the contamination of the toner detection sensor 135 with the toner, which enables to suppress the unnecessary replacement of the waste toner container 130. Further, in a case where some abnormality is causing in the toner detection sensor 135, the driving motor 212, and the like, it is possible to prohibit the execution of the image forming operation. This allows to suppress a situation where the toner overflows from the waste toner container 130 due to the fact that the accumulation information of the waste toner container 130 becomes incapable of being detected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-004222, filed Jan. 13, 2015, and No. 2015-004523, filed Jan. 13, 2015, which are hereby incorporated by reference herein in their entirety.

What is claimed is:

1. An image forming apparatus comprising:

an image carrier on which a toner image is formed;

a transfer unit configured to transfer the toner image to a sheet from the image carrier;

a cleaner configured to remove toner remaining on the image carrier after the transfer;

a waste toner container having a screw and being configured to contain the toner removed by the cleaner as waste toner;

a sensor configured to sense an amount of the waste toner;

a first determination unit configured to determine an amount of the waste toner in the waste toner container based on a number of sheets to which the toner image is transferred;

a motor configured to drive the screw;

a detection unit configured to detect a driving force of the motor; and a second determination unit configured to determine a state of the waste toner container based on the amount of the waste toner determined by the first determination unit or the driving force detected by the detection unit after the amount of the waste toner detected by the sensor is larger than a predetermined amount.

2. The image forming apparatus according to claim 1, wherein the detection unit is further configured to detect a rotation speed of the motor, and wherein the second determination unit is further configured to determine the state of the waste toner container depending on the rotation speed.

3. The image forming apparatus according to claim 2, further comprising:

a storage unit configured to store a reference value of a rotation speed for determining the state of the waste toner container depending on the rotation speed, wherein the second determination unit is further configured to compare the rotation speed with the reference value of the rotation speed stored in the storage unit, and determine the state of the waste toner container based on the comparison result.

4. The image forming apparatus according to claim 3, wherein the storage unit is further configured to store a reference value of a first rotation speed representing a state of performing replacement preparation of the waste toner container, a reference value of a second rotation speed representing a state of performing replacement of the waste toner container, and a reference value of a third rotation speed representing an error state.

5. The image forming apparatus according to claim 1, wherein the detection unit is further configured to detect a driving current of the motor, and wherein the second determination unit is further configured to determine the state of the waste toner container based on the driving current.

6. The image forming apparatus according to claim 5, further comprising a storage unit configured to store a reference value of the driving current for determining the state of the waste toner container depending on the current value of the driving current, wherein the second determination unit is further configured to compare the current value of the driving current with the reference value of the driving current stored in the second storage unit, and determine the state of the waste toner container based on the comparison result.

7. The image forming apparatus according to claim 6, wherein the storage unit is further configured to store a reference value of a first driving current representing a state of performing replacement preparation of the waste toner container, a reference value of a second driving current representing a state of performing replacement of the waste toner container, and a reference value of a third driving current representing an error state.

8. The image forming apparatus according to claim 1, further comprising:

a storage unit configured to store a reference value of waste toner amount for determining the state of the waste toner container depending on the recovered toner amount, wherein the second determination unit is further configured to compare the waste toner amount with the reference value of the waste toner amount stored in the storage unit to determine the state of the waste toner container based on the comparison result.

9. The image forming apparatus according to claim 8, wherein the storage unit is further configured to store a reference value of a first waste toner amount representing a state of performing replacement preparation of the waste toner container and a reference value of a second waste toner amount representing a state of performing replacement.

10. An image forming apparatus comprising:

an image forming unit configured to form an image on an image carrier with toner based on image data;

a transfer unit configured to transfer the image formed on the image carrier to a sheet;

a cleaning unit configured to clean toner remaining on the image carrier without being transferred to the sheet by the transfer unit;

a conveyance unit configured to convey the toner cleaned by the cleaning unit;

an accumulation container configured to receive the toner conveyed by the conveyance unit from a receiving port, the accumulation container including a rotating member which rotates for moving the toner accumulated in the accumulation container;

a driving unit configured to drive the rotating member;

a detection unit configured to detect accumulation information related to the toner amount accumulated in the accumulation container;

an obtaining unit configured to obtain driving information of the driving unit;

a notifying unit configured to provide a notification indicating time to replace the accumulation container; and a control unit configured to control the notifying unit based on the accumulation information detected by the detection unit and the driving information obtained by the obtaining unit.

11. The image forming apparatus according to claim 10, wherein the control unit is further configured not to provide the notification by the notifying unit in a case where the toner amount accumulated in the accumulation container which corresponds to the accumulation information detected by the detection unit is less than a predetermined amount, and wherein the control unit is further configured to provide the notification by the notifying unit in a case where the toner amount accumulated in the accumulation container which corresponds to the accumulation information detected by the detection unit is more than the predetermined amount and in a case where the driving information differs from target information.

12. The image forming apparatus according to claim 11, wherein:

the driving unit includes a motor to which a predetermined voltage is applied for rotationally driving the rotating member;

the obtaining unit is further configured to obtain a current value of the motor during the rotation of the rotating member;

the target information represents a target value of the current value of the motor during the rotation of the rotating member; and the control unit is further configured to provide the information by the notifying unit in a case where the toner amount accumulated in the accumulation container which corresponds to the accumulation information detected by the detection unit is more than the predetermined amount and in a case where the current value obtained by the obtaining unit is lower than the target value.

13. The image forming apparatus according to claim 12, further comprising a determination unit configured to determine variation between first accumulation information detected at first timing and second accumulation information detected at second timing which is prior to the first timing by the detection unit, wherein the control unit is further configured not to provide the information by the notifying unit in a case where the toner amount accumulated in the accumulation container which corresponds to the accumulation information detected by the detection unit is more than the predetermined amount, in a case where the current value obtained by the obtaining unit is higher than the target value, and in a case where the variation is larger than a threshold value.

14. The image forming apparatus according to claim 11, wherein the driving unit includes a motor to which a predetermined current is applied for rotationally driving the rotating member, wherein the obtaining unit is further configured to obtain a voltage value of the motor during the rotation of the rotating member, wherein the target information represents a target value of the voltage value of the motor during the rotation of the rotating member, and wherein the control unit is further configured to provide the notification by the notifying unit in a case where the toner amount accumulated in the accumulation container which corresponds to the accumulation information detected by the detection unit is more than the predetermined amount and in a case where the voltage value obtained by the obtaining unit is lower than the target value.

15. The image forming apparatus according to claim 14, further comprising a determination unit configured to determine variation between first accumulation information detected at first timing and second accumulation information detected at second timing which is prior to the first timing by the detection unit, wherein the control unit is further configured not to provide the notification by the notifying unit in a case where the toner amount accumulated in the accumulation container which corresponds to the accumulation information detected by the detection unit is more than the predetermined amount, in a case where the voltage value obtained by the obtaining unit is higher than the target value, and in a case where the variation is larger than a threshold value.

16. The image forming apparatus according to claim 11, wherein the driving unit further includes a motor for rotationally driving the rotating member, wherein supplied electrical power of the motor is controlled such that a rotation speed of the motor reaches a target speed, and wherein the control unit is further configured to provide the notification by the notifying unit in a case where the toner amount accumulated in the accumulation container which corresponds to the accumulation information detected by the detection unit is more than the predetermined amount and in a case where the rotation speed of the motor obtained by the obtaining unit is slower than the target speed.

17. The image forming apparatus according to claim 16, further comprising a determination unit configured to determine variation between first accumulation information detected at first timing and second accumulation information detected at second timing which is prior to the first timing by the detection unit, wherein the control unit is further configured not to provide the notification by the notifying unit in a case where the toner amount accumulated in the accumulation container which corresponds to the accumulation information detected by the detection unit is more than the predetermined amount, in a case where the rotation speed of the motor obtained by the obtaining unit is faster than the target speed, and in a case where the variation is larger than a threshold value.

18. The image forming apparatus according to claim 10, wherein the accumulation container further comprises a detection area through which light is transmitted, and wherein the detection unit further comprises an irradiation unit for irradiating light to the detection area of the accumulation container and a light receiving unit for receiving light having passed through the detection area.

19. The image forming apparatus according to claim 10, further comprising a prohibition unit configured to prohibit an image forming operation of the image forming unit, wherein the prohibition unit is further configured to prohibit the image forming operation of the image forming unit when the image forming unit has formed images of a predetermined number of pages after the notification is provided by the notifying unit.

* * * * *